US010253572B2

(12) United States Patent
Braniff

(10) Patent No.: US 10,253,572 B2
(45) Date of Patent: Apr. 9, 2019

(54) REDUNDANT OR COMBINATION TRAVERSING AND RHC SYSTEMS FOR DERRICK STRUCTURES

(71) Applicant: Transocean Sedco Forex Ventures Limited, George Town, Grand Cayman (KY)

(72) Inventor: Brendan B. Braniff, Houston, TX (US)

(73) Assignee: Transocean Sedco Forex Ventures Limited, Grand Cayman (KY)

( * ) Notice: Subject to any disclaimer, the term of this patent is extended or adjusted under 35 U.S.C. 154(b) by 0 days.

(21) Appl. No.: 15/672,641

(22) Filed: Aug. 9, 2017

(65) Prior Publication Data

US 2018/0044995 A1 Feb. 15, 2018

Related U.S. Application Data

(60) Provisional application No. 62/490,851, filed on Apr. 27, 2017, provisional application No. 62/372,674, filed on Aug. 9, 2016.

(51) Int. Cl.

| | |
|---|---|
| ***E21B 15/00*** | (2006.01) |
| ***E21B 19/14*** | (2006.01) |
| ***E21B 19/00*** | (2006.01) |
| ***E21B 19/22*** | (2006.01) |

(52) U.S. Cl.

CPC ..... *E21B 15/003* (2013.01); *E21B 19/008* (2013.01); *E21B 19/14* (2013.01); *E21B 19/22* (2013.01)

(58) Field of Classification Search

CPC ..... E21B 15/00; E21B 15/003; E21B 19/02; E21B 19/00; E21B 19/04; B66D 1/38; B66D 1/40; B66D 3/08

See application file for complete search history.

(56) References Cited

U.S. PATENT DOCUMENTS

| | | | | |
|---|---|---|---|---|
| 3,652,058 A | | 3/1972 | Ashton | |
| 4,390,162 A | | 6/1983 | Woolslayer | |
| 4,417,846 A | | 11/1983 | Elliston | |
| 4,836,300 A | * | 6/1989 | Reed | B66D 3/043 175/57 |
| 5,762,279 A | * | 6/1998 | Horton, III | E21B 19/02 254/285 |
| 9,714,546 B2 | * | 7/2017 | Kannegaard | E21B 15/02 |
| 2014/0332487 A1 | * | 11/2014 | Boutwell, Jr. | B66C 19/00 212/199 |

FOREIGN PATENT DOCUMENTS

| | | | | |
|---|---|---|---|---|
| EP | 0157864 B1 | * | 1/1987 | E02F 9/067 |

* cited by examiner

*Primary Examiner* — D. Andrews

(57) ABSTRACT

A derrick structure may include a plurality of drilling rotating/hoisting/circulation (RHC) traveling block/top drive like systems that can move between and are fully functional on multiple well centers. With such a configuration, one RHC can be disconnected from the drill lines and suspended in the drilling derrick allowing two hoisting systems with separate motors to function simultaneously on a single well center, thus doubling the lifting capability on that well center. For example, one traveling block may be suspended and its associated drill line and winch coupled to another traveling block on a different well center.

21 Claims, 26 Drawing Sheets

TRAVELING BLOCK DETAIL 'A'
RIGGED FOR DOUBLE
LOAD CAPACITY

TRAVELING BLOCK DETAIL 'B'
RIGGED FOR DOUBLE
HANG-OFF

REDUNDANT OR COMBINATION TRAVERSING AND RHC SYSTEMS FOR DERRICK STRUCTURES

CROSS-REFERENCE TO RELATED PATENT APPLICATIONS

This application claims priority to U.S. provisional patent application Ser. No. 62/372,674, filed Aug. 9, 2016, and U.S. provisional patent application Ser. No. 62/490,851, filed Apr. 27, 2017, both entitled "Reconfigurable Drill Lines for a Derrick Structure." All of these applications are incorporated by reference in their entireties herein.

FIELD OF THE DISCLOSURE

The instant disclosure relates to derrick structures. More specifically, portions of this disclosure relate to redundant and/or combination skidding/traversing and rotating/hoisting/circulation ("RHC") systems on derrick structures.

BACKGROUND

In systems with stationary derrick structures with multiple well centers, conventionally equipment for each well center is duplicated and operated independently. Each well center thus has its own equipment configured to provide support for operations on only one drill line for one well center. Shortcomings mentioned here are only representative and are included simply to highlight that a need exists for improved derrick structures. Embodiments described herein address certain shortcomings but not necessarily each and every one described here or known in the art.

SUMMARY

A derrick structure, especially one that is stationary, may include a plurality of drilling rotating/hoisting/circulation (RHC) traveling block/top drive like systems which can move between and are fully functional on multiple well centers. With such a configuration, one RHC can be disconnected from the drill lines and suspended in the drilling derrick allowing two hoisting systems to function simultaneously on a single well center, thus doubling the lifting capability on that well center. Further, in some embodiments, multiple false rotary table type skid carts (SFRT) can move between and are fully functional on multiple well centers. The SFRTs may be configured to move between and operate above conventional rotary tables. The SFRTs may be designed to support the maximum operational loads and sized to accommodate all available equipment which would fit inside or interface with any conventional rotary table. No previous derrick configuration has been capable of skidding traveling blocks, including RHC systems or top drives, between multiple well centers within a stationary derrick/drilling tower.

Embodiments of the systems described herein may allow that: should one RHC be taken out of service/offline, that RHC can be moved to another well center and another RHC can be quickly moved into position in order to continue with operations. Further, in some embodiments, the RHC when offline can be prepared to perform online operations without impacting activities on the online well center. The RHC can then be quickly moved into position on the online/main well center to continue with operations, thus removing the time which would otherwise be required to rig up equipment should this capability not exist. Still further, in some embodiments, running equipment such as a riser spider and gimbal, casing running equipment, well test equipment, casing running equipment (e.g., any equipment required to be rigged up to perform any online operations) can be rigged up on a SFRT and then quickly skidded into position on the main or auxiliary well centers.

According to one embodiment, a method may include adjusting a height of a first traveling block to a rack on a derrick; and moving a first moveable sheave or motor to skid, along the rack, the first traveling block from a first well center to a second well center.

According to another embodiment, a method may include controlling a first motor to adjust a height of a first traveling block to a rack on a derrick; and controlling a first moveable sheave or the motor coupled to the first traveling block to skid, along the rack, the first traveling block from a first well center to a second well center.

According to a further embodiment, an apparatus may include a controller configured to couple to equipment on a derrick, the equipment comprising a first motor for reeling in or reeling out a first drill line, a second motor for reeling in or reeling out a second drill line, a first sheave motor for moving a first moveable sheave coupled to the first drill line, and a second sheave motor for moving a second moveable sheave coupled to the second drill line. Alternatively, the first and second moveable sheaves can be removed and the first and second sheave motors replaced by first and second drive motor systems for moving the first and second motors, respectively. The controller may be configured to perform steps including controlling the first motor to adjust a height of a first traveling block to a rack on a derrick by reeling in or reeling out the first drill line; and controlling a first moveable sheave or the first motor coupled to the first traveling block to skid, along the rack, the first traveling block from a first well center to a second well center.

According to another embodiment, an apparatus may include a first motor configured to reel in and out a first drill line; a second motor configured to reel in and out a second drill line; a first traveling block configured to couple to the first drill line; a second traveling block configured to couple to the second drill line; a rack spanning at least two well centers; and a rail skidding mechanism coupled to the rack and configured to allow skidding of the first traveling block between some of the at least two well centers. The apparatus may further comprise: a first sheave set comprising at least a first movable sheave and configured to reel in and reel out the first drill line; and a second sheave set comprising at least a second movable sheave and configured to reel in and out the second drill line.

The foregoing has outlined rather broadly certain features and technical advantages of embodiments of the present invention in order that the detailed description that follows may be better understood. Additional features and advantages will be described hereinafter that form the subject of the claims of the invention. It should be appreciated by those having ordinary skill in the art that the conception and specific embodiment disclosed may be readily utilized as a basis for modifying or designing other structures for carrying out the same or similar purposes. It should also be realized by those having ordinary skill in the art that such equivalent constructions do not depart from the spirit and scope of the invention as set forth in the appended claims. Additional features will be better understood from the following description when considered in connection with the accompanying figures. It is to be expressly understood, however, that each of the figures is provided for the purpose of illustration and description only and is not intended to limit the present invention.

The term "coupled" is defined as connected, although not necessarily directly, and not necessarily mechanically; two items that are "coupled" may be unitary with each other. The terms "a" and "an" are defined as one or more unless this disclosure explicitly requires otherwise.

Further, a device or system that is configured in a certain way is configured in at least that way, but it can also be configured in other ways than those specifically described.

The terms "comprise" (and any form of comprise, such as "comprises" and "comprising"), "have" (and any form of have, such as "has" and "having"), "include" (and any form of include, such as "includes" and "including") and "contain" (and form of contain, such as "contains" and "containing") are open-ended linking verbs. As a result, an apparatus that "comprises," "has," "includes," or "contains" one or more elements possesses those one or more elements, but is not limited to possessing only those elements. Likewise, a method that "comprises," "has," "includes," or "contains" one or more steps possesses those one or more steps, but is not limited to possessing only those one or more steps.

Any embodiment of any of the apparatuses, systems, and methods can consist of or consist essentially of—rather that comprise/include/contain/have—any of the described steps, elements, and/or features. Thus, in any of the claims, the term "consisting of" or "consisting essentially of" can be substituted for any of the open-ended linking verbs recited above, in order to change the scope of a given claim from what it would otherwise be using the open-ended linking verb.

The feature or features of one embodiment may be applied to other embodiments, even though not described or illustrated, unless expressly prohibited by this disclosure or the nature of the embodiments.

BRIEF DESCRIPTION OF THE DRAWINGS

For a more complete understanding of the disclosed system and methods, reference is now made to the following descriptions taken in conjunction with the accompanying drawings.

DETAILED DESCRIPTION

Embodiments of the systems described herein allow moving a traveling block or RHC between well centers. Moveable RHC guiderails may be included to provide lateral support to the RHC during movement. The moveable RHC guiderail may move synchronously with the sliding crown sheave set and/or motor. In some embodiments, two sets of crown sheaves may skid forward and backwards on the same level on top of the derrick. In some embodiments, a single layer type (SLW) or other winch motor may be positioned above the rigfloor, and/or the rotation of the SLW drum may be parallel to the well centers. In some embodiments, no sheaves are employed and traveling blocks are operated directly by single layer type (SLW) or other winch motors positioned at the crown of the derrick, and which are configured to skid along the crown.

Using embodiments of the system described herein, equipment rigged up on the RHCs and SFRTs (described below) may be performed offline, which may improve operational efficiency and cost savings. Further, planned and unplanned maintenance on the RHCs may be performed offline, such as by replacing the online RHC by skidding the offline RHC into its position, which may improve operational efficiency and cost savings. Still further, a load path capacity may be increased, such as doubled or more, by connecting two or more sliding crown sheave sets or motors to a single RHC or traveling block assembly.

Figure 1A:
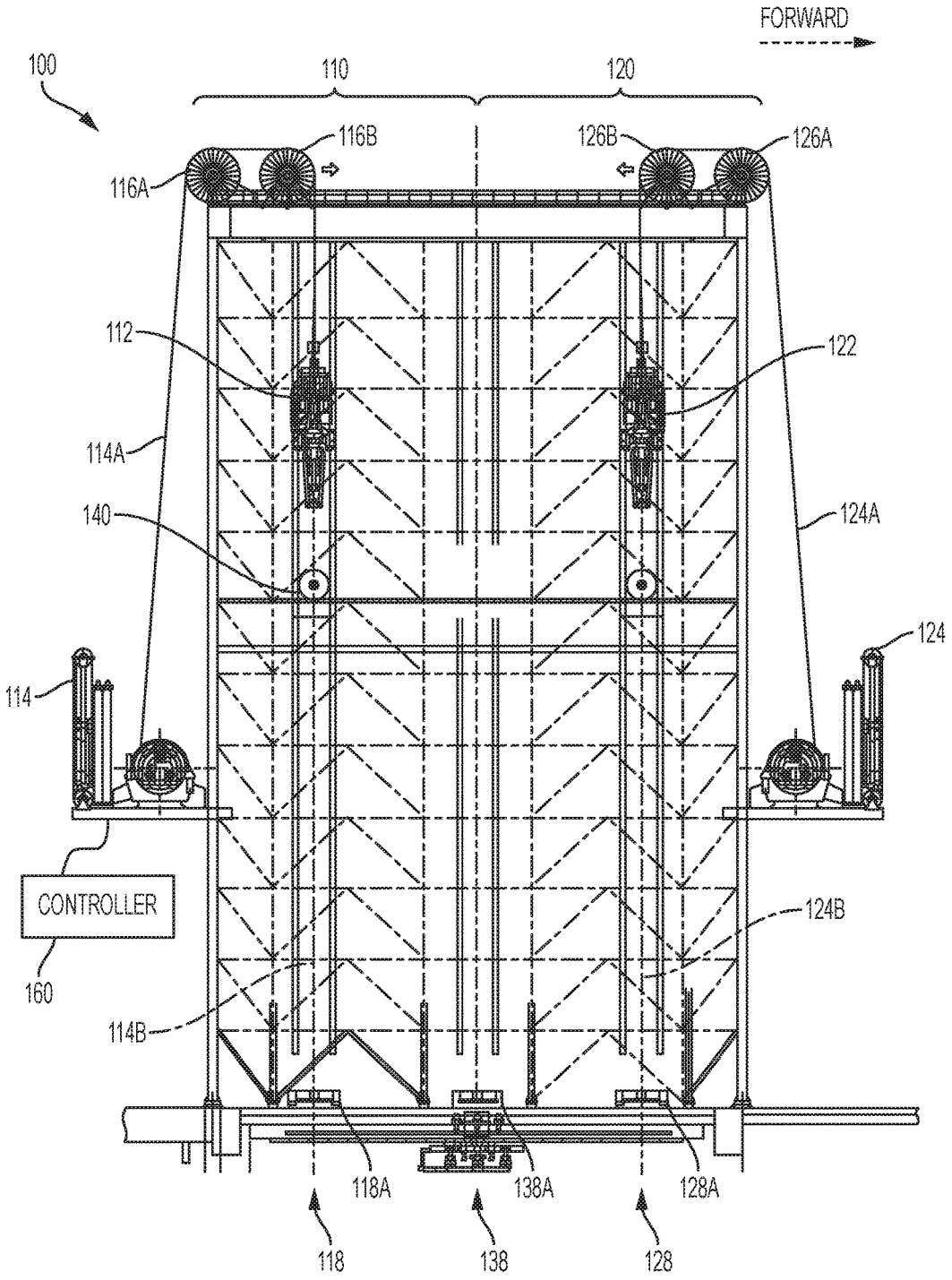
FIG. 1A is a side view of an example drilling derrick according to one embodiment of the disclosure.
Figure 1B:
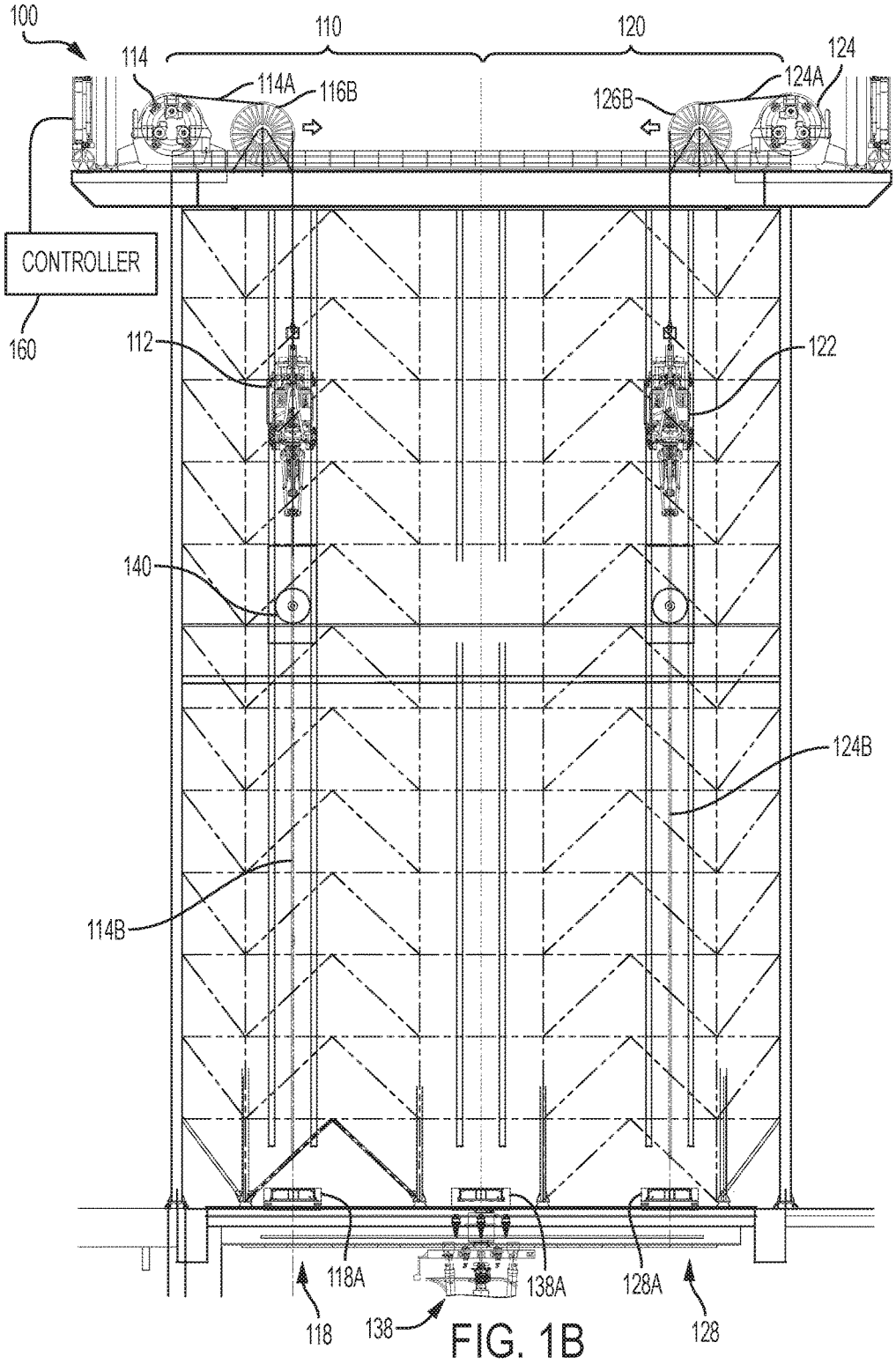
FIG. 1B is a side view of another example drilling derrick according to one embodiment of the disclosure.
Figure 1C:
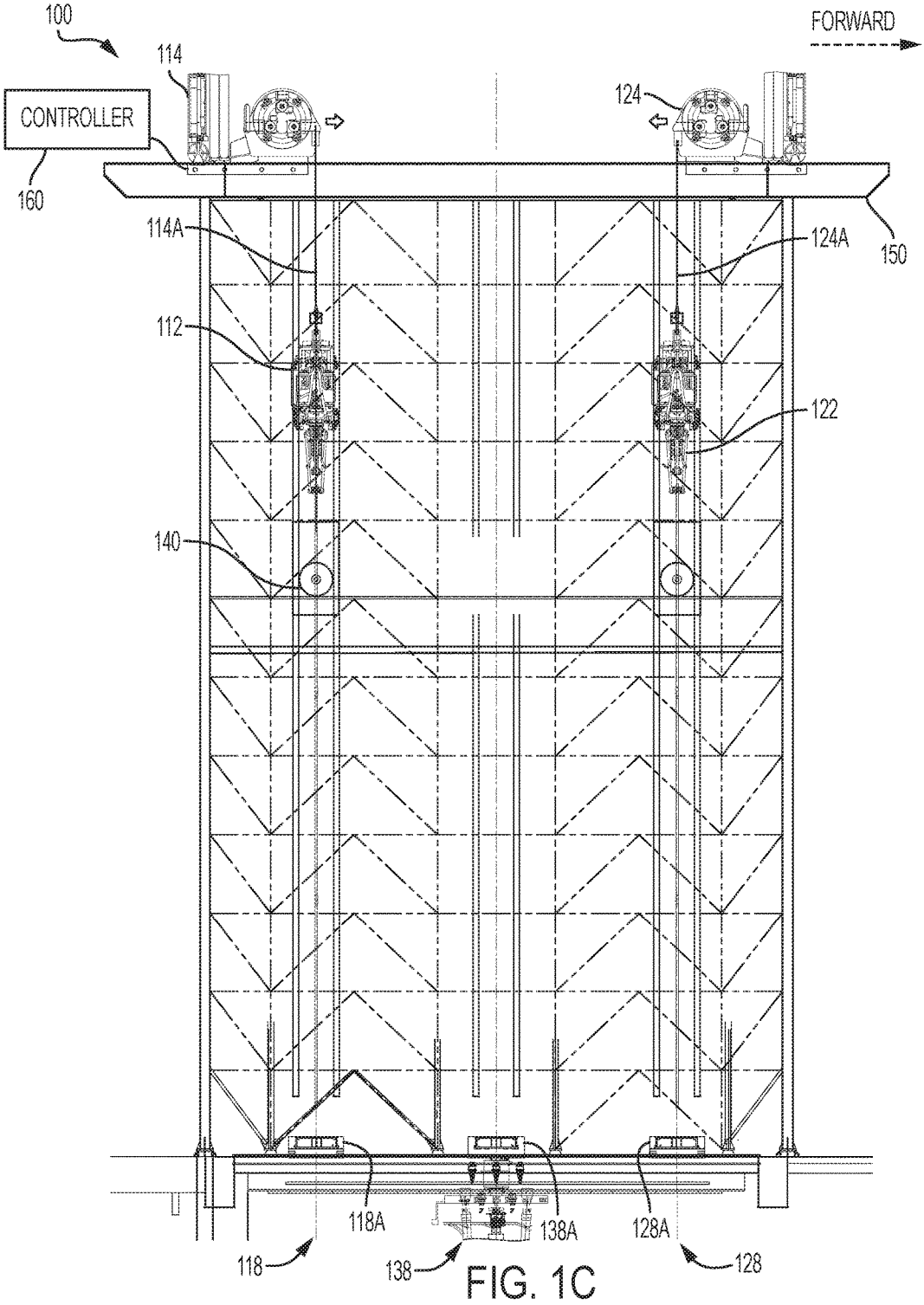
FIG. 1C is a side view of yet another example drilling derrick according to one embodiment of the disclosure.

FIG. 1A is a side view of a drilling derrick according to one embodiment of the disclosure. A derrick 100 may include multiple sets of traveling blocks, such as rotating/hoisting/circulation (RHC) systems. For example, two traveling blocks 112 and 122 are shown as part of two assemblies 110 and 120, respectively, over two well centers 118 and 128. The traveling blocks 112 and 122 may be supported by drill lines 114A and 124A, respectively. The drill lines 114A and 124A may couple to motors, such as single layer winches (SLW), 114 and 124, respectively. The drill lines 114A and 124A may run from the motors 114 and 124, respectively, to stationary sheave sets 116A and 126A, respectively, to the sliding crown sheave sets 116B and 126B, respectively, and then be connected to traveling blocks 112 and 122, respectively, by means of, for example, quick fitting connections (see, e.g., connections shown in FIGS. 7C and 7D). Each traveling block can be supported by either one or two sets of drill lines from either one or two of the sliding sheave sets or motors, or more. For example, if there are four drill lines from each motor, the traveling block can be supported/raised/lowered by either four lines (of one sheave set) or by eight lines (of two sheave sets). Connecting lines from multiple sheave sets may allow both sliding crown sheave sets to support a single RHC (or other single basic traveling block type assembly), thus doubling the lifting capacity on that well center. Although two assemblies 110 and 120 are shown for two traveling blocks 112 and 122 over three wells 118, 128, and 138, different numbers of assemblies, traveling blocks, and/or wells may be configured on a derrick. For example, additional traveling blocks may be supported by more assemblies, each with more sheave sets and motors. The motors 114 and 124 may be, for example, single layer type (SLW) active and passive compensating winches located at a height above the rigfloor, for example, as shown in FIG. 1A, which allows movement of tubulars and equipment into and out of the rigfloor below the motors 114 and 124. The motors 114 and 124 may also be located at the top of the derrick 100 in place of stationary sheave sets 116A and 126A. Such an arrangement is shown in FIG. 1B. In yet another embodiment, the motors 114 and 124 may be located at the top of the derrick 100 in addition to stationary sheave sets 116A and 126A. In yet another embodiment, the motors 114 and 124 may also be located at the top of the derrick 100 in place of both stationary sheave sets 116A, 126A and sliding sheave sets 116B, 126B, respectively. Such an arrangement is shown in FIG. 1C. The rotation of the drum on the SLW motors may be parallel to the well centers, such as shown in and described with reference to FIG. 10A. In some embodiments, full dual activity operational capability may be achievable using two or more traveling blocks on the derrick 100.

Figure 1D:
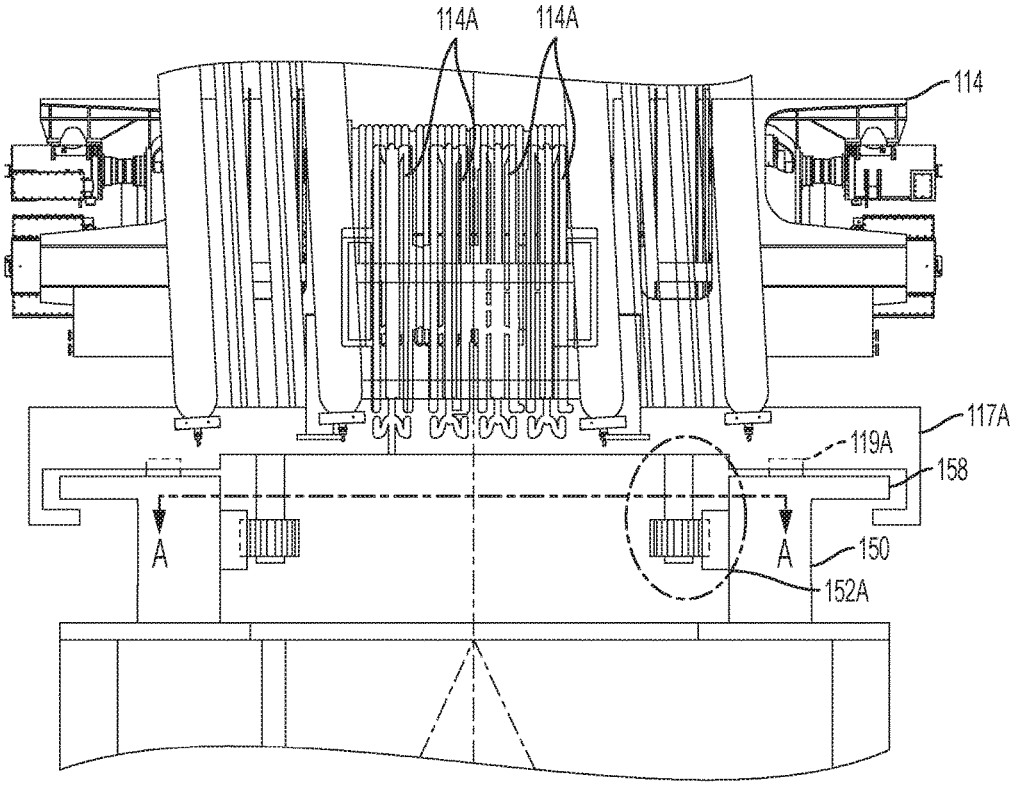
FIG. 1D is an aft view of a portion of the drilling derrick of FIG. 1C according to one embodiment of the disclosure.
Figure 1E:
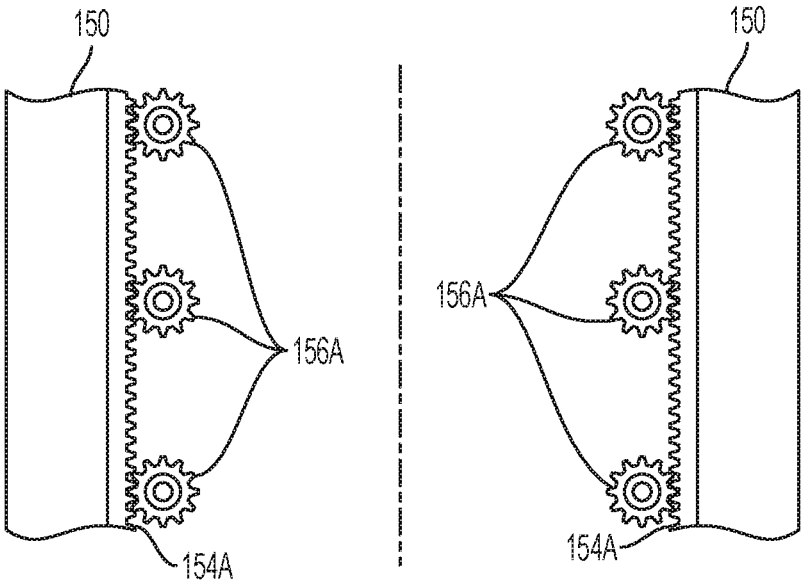
FIG. 1E is a cross-sectional plan view of a portion of FIG. 1D along the line A-A according to one embodiment of the disclosure.

Each assembly 110 and 120 may include two sheave sets: one sliding and one stationary sheave set. For example, assembly 110 may include stationary sheave set 116A and sliding sheave set 116B and assembly 120 may include stationary sheave set 126A and sliding sheave set 126B. One set of sheaves may be included at a forward side of the derrick 100 and one set of sheaves may be included at an aft side of the derrick 100. The sliding sheave sets 116B and 126B are moveable and are able to be, for example, skid between multiple well centers along, for example, skid beam 150. Alternatively, as shown in FIG. 1B, motors 114 and 124 may be mounted on top of the derrick in place of, or in addition to, the stationary sheave sets 116A and 126A. The load experienced by the derrick may be different between the example embodiments of FIG. 1A and FIG. 1B. For example, the load may be smaller, by as much as half, with the motors mounted on top of the derrick. In a further alternative, as shown in FIG. 1C, motors 114 and 124 may be mounted in place of both stationary sheave sets 116A, 126A and sliding sheave sets 116B, 126B, respectively, and configured to directly hoist and suspended one or more RHCs. In such a configuration, a controller, such as controller 160, is not required to have the capability to maintain the height of a suspended RHC, such as traveling blocks 112, 122, while the RHC is moving between well centers. Instead, motors 114 and 124, which can include a controller 160, themselves slide along skid beam 150 to maintain the height of the traveling blocks 112 and 122, respectively, without adjusting the length of drill lines 114A, 124A, respectively. Motors 114 and 124 can slide along skid beam 150 by operation of a drive system, such as rack and pinion drive systems 152, an example of which is shown and described with reference to FIGS. 1D and 1E. Drive system 152A, configured to move motor 114, includes one or more racks 154A positioned on skid beam 150. Drive systems 152A further includes one or more pinion gears 156A configured to be received by and mate with racks 154A and be rotationally coupled to a support frame 117A of motor 114. Support frame 117A, which may include one or more rollers 119A, is coupled to flanges 158 of skid beam 150 such that relative vertical movement between motor 114 and skid beam 150 is restricted (but transverse movement is permitted).

The derrick 100 may include a set of RHC guide rails (also known as dolly tracks) for each well center. These guiderails include a section of the guiderail which can move between well centers while providing lateral support to the RHC. That is, the RHC remains attached/supported by that section of the guiderail which is moving between well centers. A guiderail skidding mechanism 140 may skid/move the guiderail (either 'empty' or while supporting, for example, an RHC) between two or more well centers. The sliding guiderails may align with fixed guiderail sections on each well center to allow the RHC to be raised and lowered, while being supported laterally by the complete guiderail arrangement during the course of all operations. In some embodiments, the skidding guiderails will move synchronously with the relevant skidding crown sheave set or motor when providing lateral support to a RHC. During this movement between well centers, the motor may reel the drill lines in (or out), if necessary, to maintain the RHC at a constant height, and thereby stationary with respect to the moveable guiderails. Such functions can be performed by, for example, a controller 160 coupled to the motor. In embodiments with moveable motors, such as shown in FIG. 1C, a control system, such as controller 160, may not be needed to maintain the RHC at a fixed height during skidding (but may be needed for other functions).

The derrick 100 may include multiple false rotary table type skid carts (SFRTs) 118A, 128A, and 138A, which can skid between multiple well centers. The skid carts may support the maximum operational loads and be sized to accommodate all available equipment which would fit inside or interface with any conventional rotary table. A false rotary table skidding system may allow the SFRTs to skid between all well centers and will allow skidding to any part of the drillfloor or areas outside of the drillfloor as determined by the position of the skidding arrangement, thus allowing equipment to be assembled or prepared on or in the false rotary tables using either the RHC, rigfloor winches, or cranes either on or outside of the drillfloor. In some embodiments, a central false rotary table, such as SFRT 138A, is not included so as to more easily allow other skid carts, such as SFRT 118A or 128A, to skid between the central well center.

Figure 2:
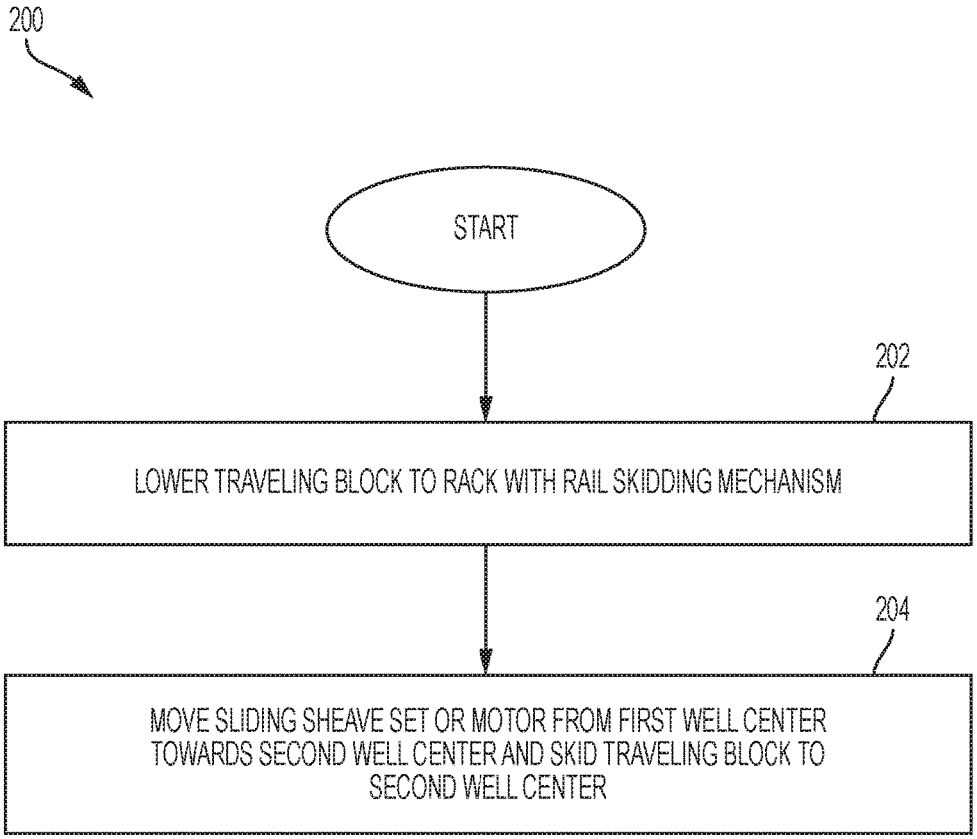
FIG. 2 is a flow chart illustrating an example method for moving a traveling block between well centers according to some embodiments of the disclosure.
Figure 3A:
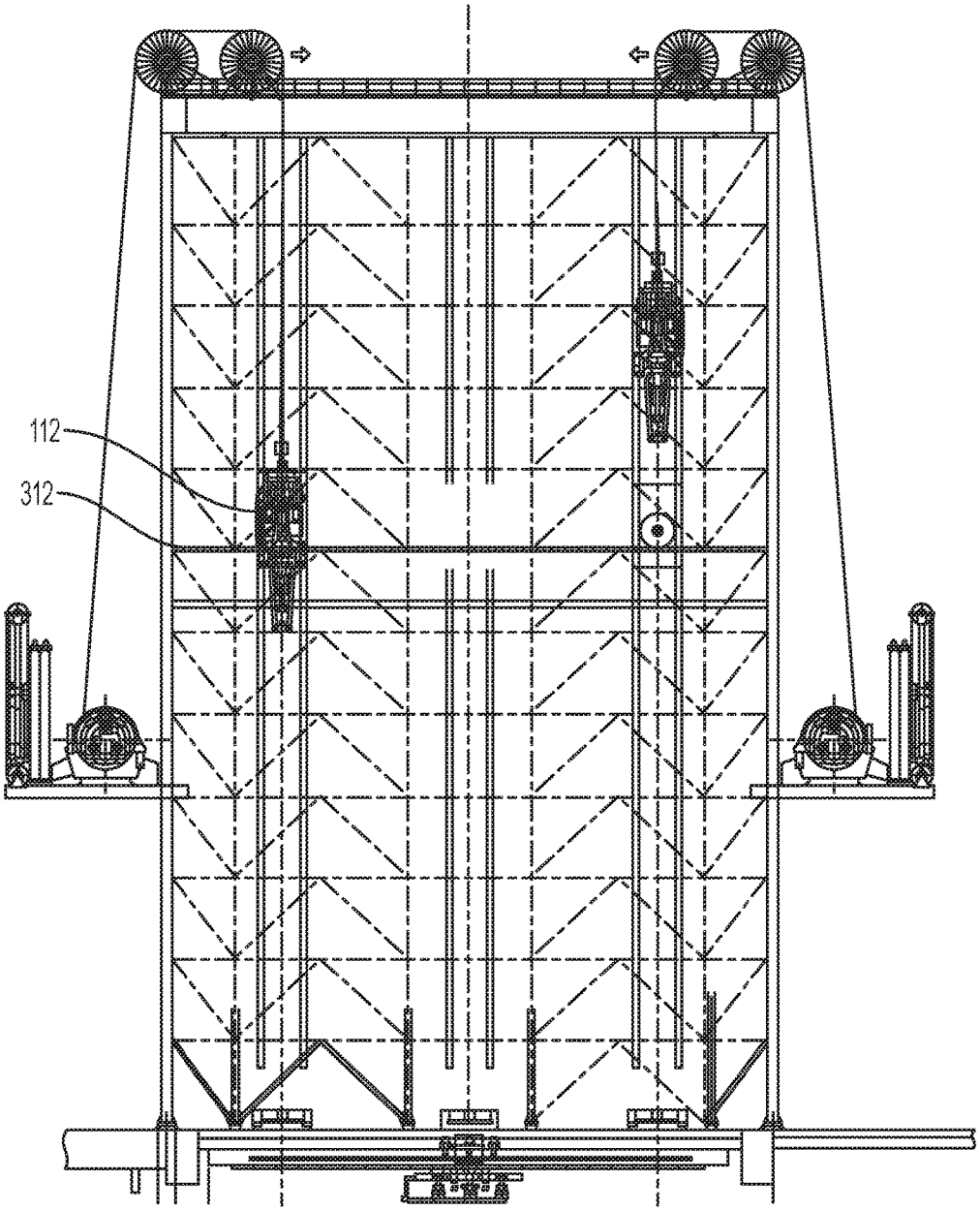
FIG. 3A is a side view of an example drilling derrick after lowering a traveling block according to one embodiment of the disclosure.
Figure 3B:
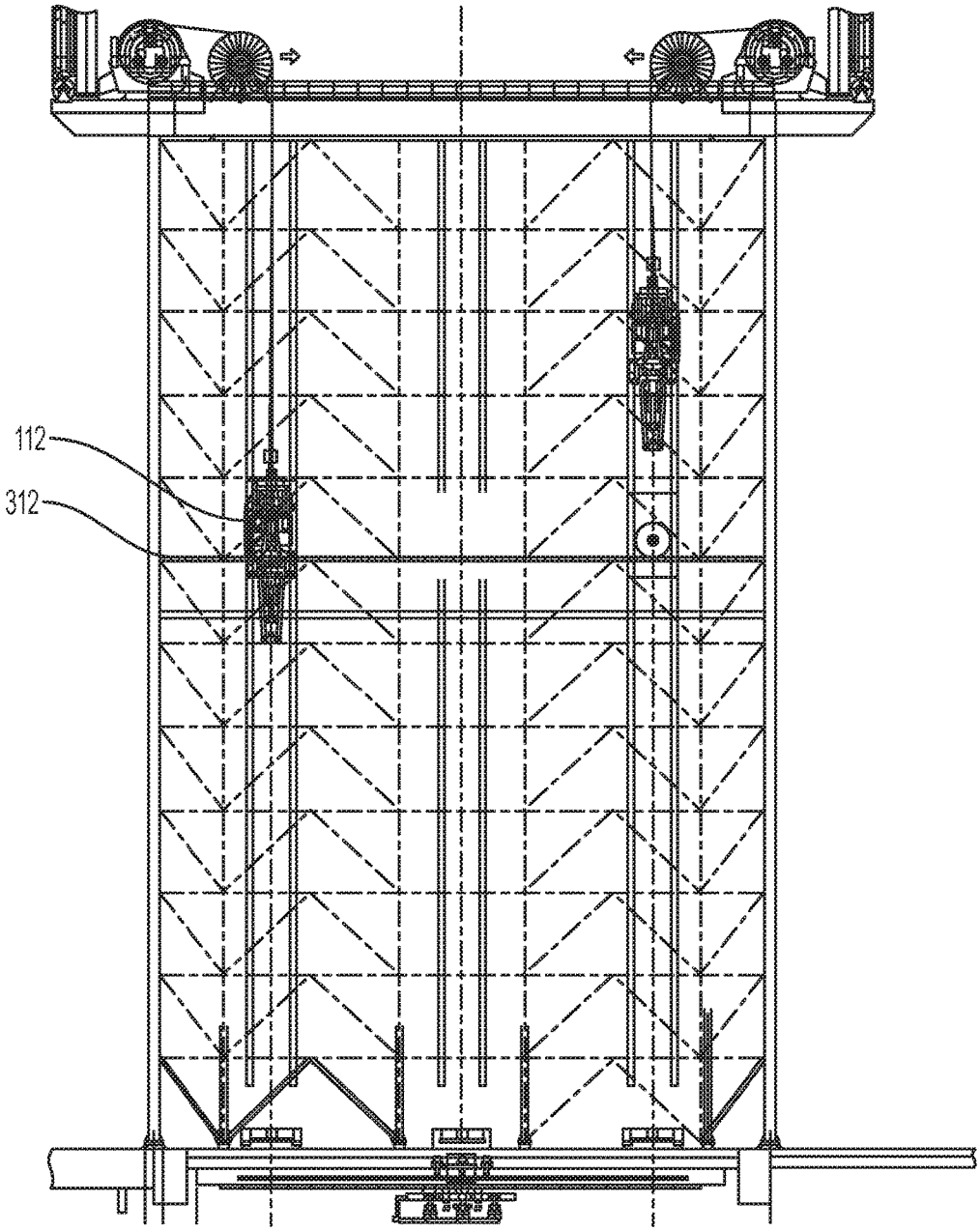
FIG. 3B is a side view of another example drilling derrick after lowering a traveling block according to one embodiment of the disclosure.
Figure 3C:
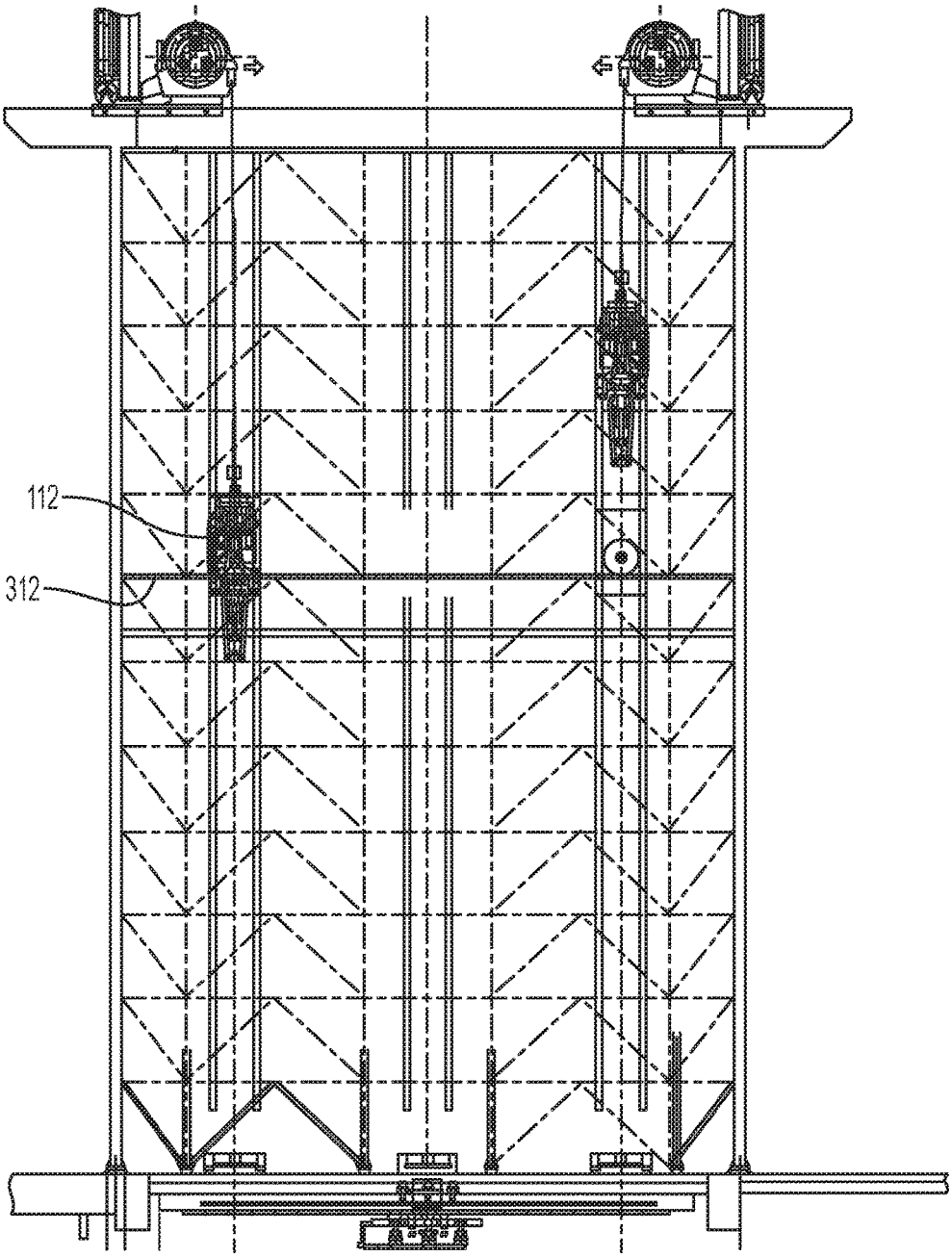
FIG. 3C is a side view of yet another example drilling derrick after lowering a traveling block according to one embodiment of the disclosure.

A method of moving or skidding one of the traveling blocks from a first well center to a second well center is described with reference to FIG. 2. FIG. 2 is a flow chart illustrating an example method for moving a traveling block between well centers according to some embodiments of the disclosure. A method 200 may begin at block 202 with lowering a traveling block to a rack that has a rail skidding mechanism. Examples of a derrick during lowering of the traveling block are shown in FIGS. 3A, 3B, and 3C. FIGS. 3A, 3B, and 3C are side views of example drilling derricks after lowering a traveling block according to some embodiments of the disclosure. Traveling block 112 is lowered to rack 312.

Figure 4A:
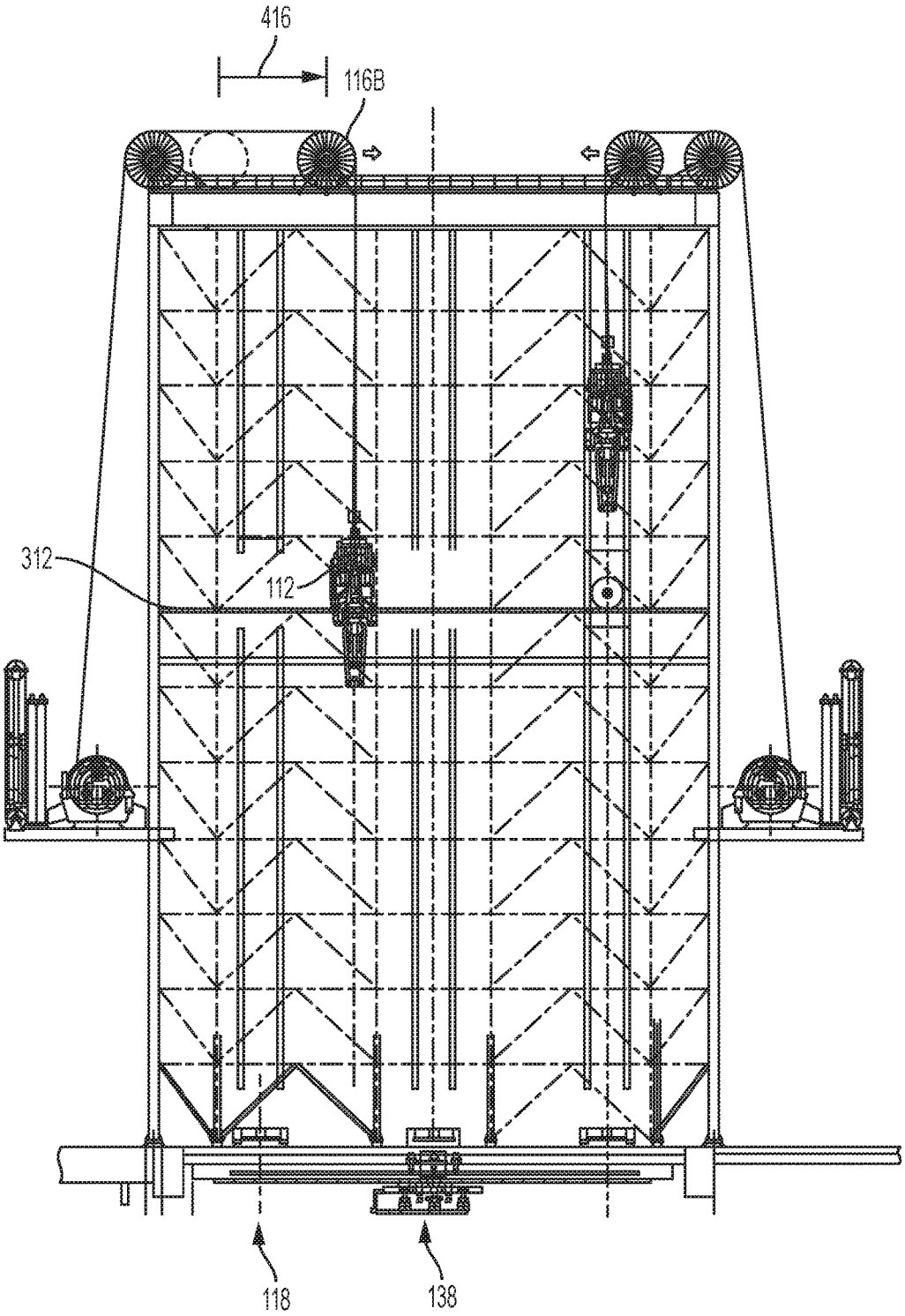
FIG. 4A is a side view of an example drilling derrick after moving a traveling block along a rack according to one embodiment of the disclosure.
Figure 4B:
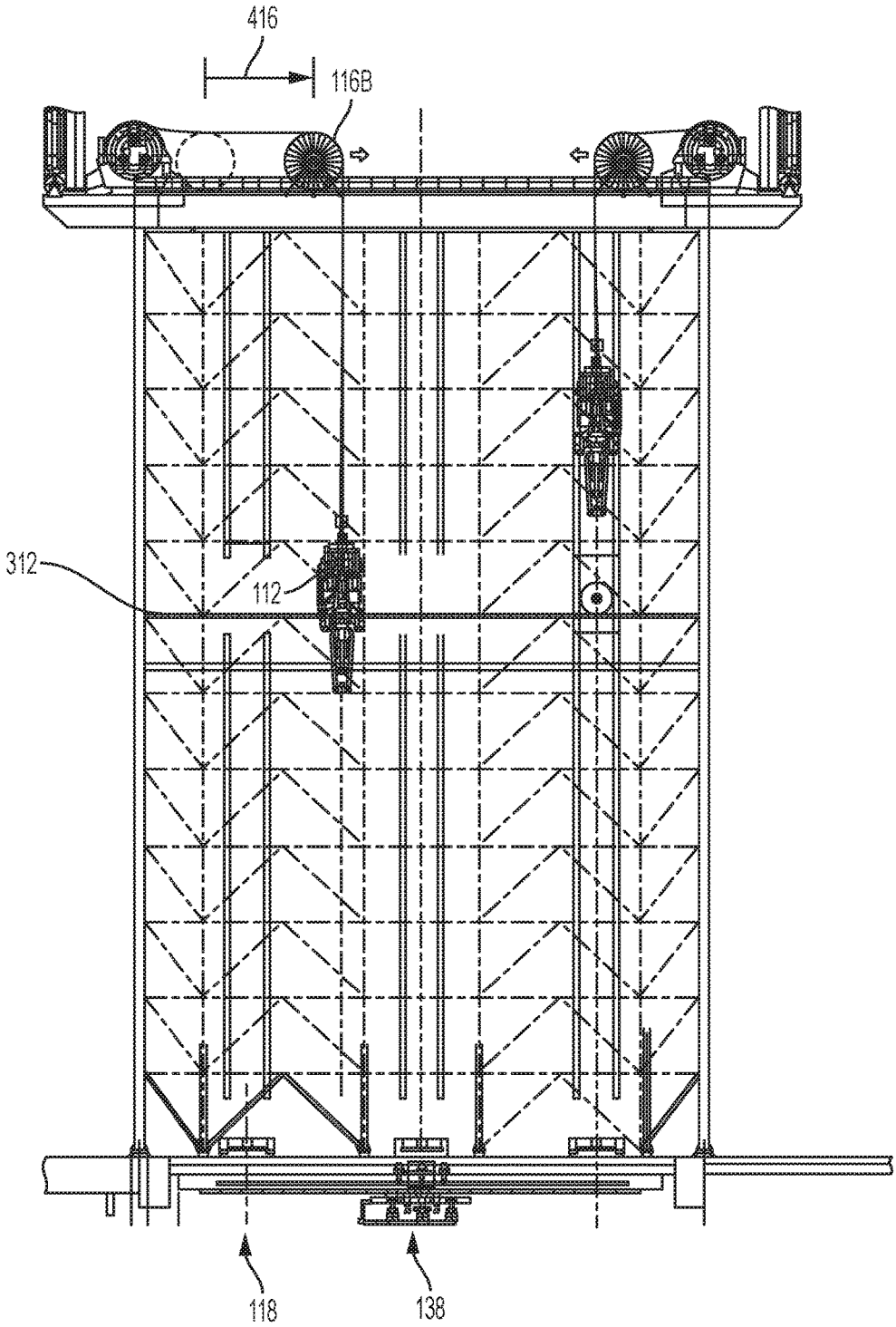
FIG. 4B is a side view of another example drilling derrick after moving a traveling block along a rack according to one embodiment of the disclosure.
Figure 4C:
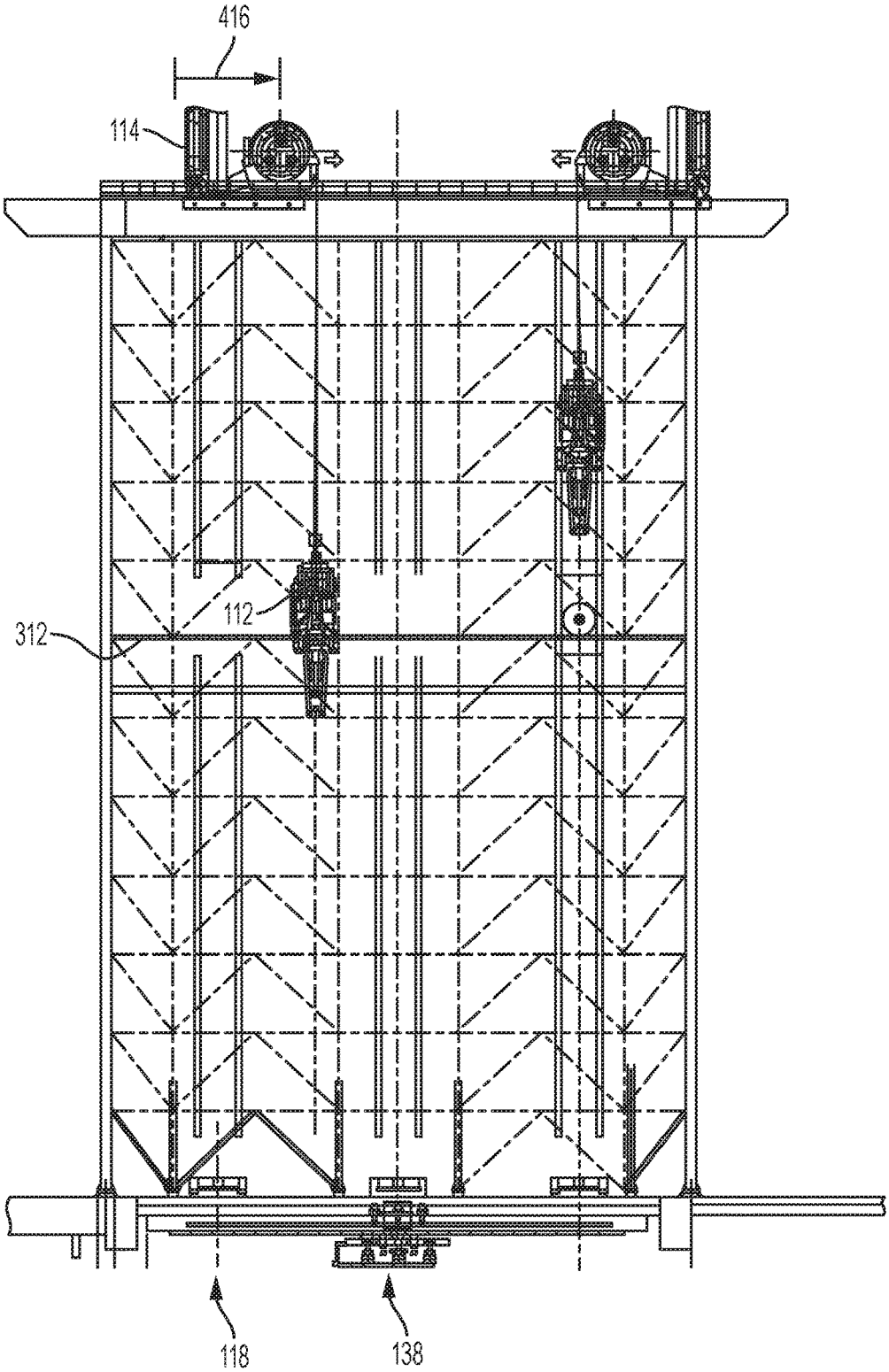
FIG. 4C is a side view of yet another example drilling derrick after moving a traveling block along a rack according to one embodiment of the disclosure.
Figure 5A:
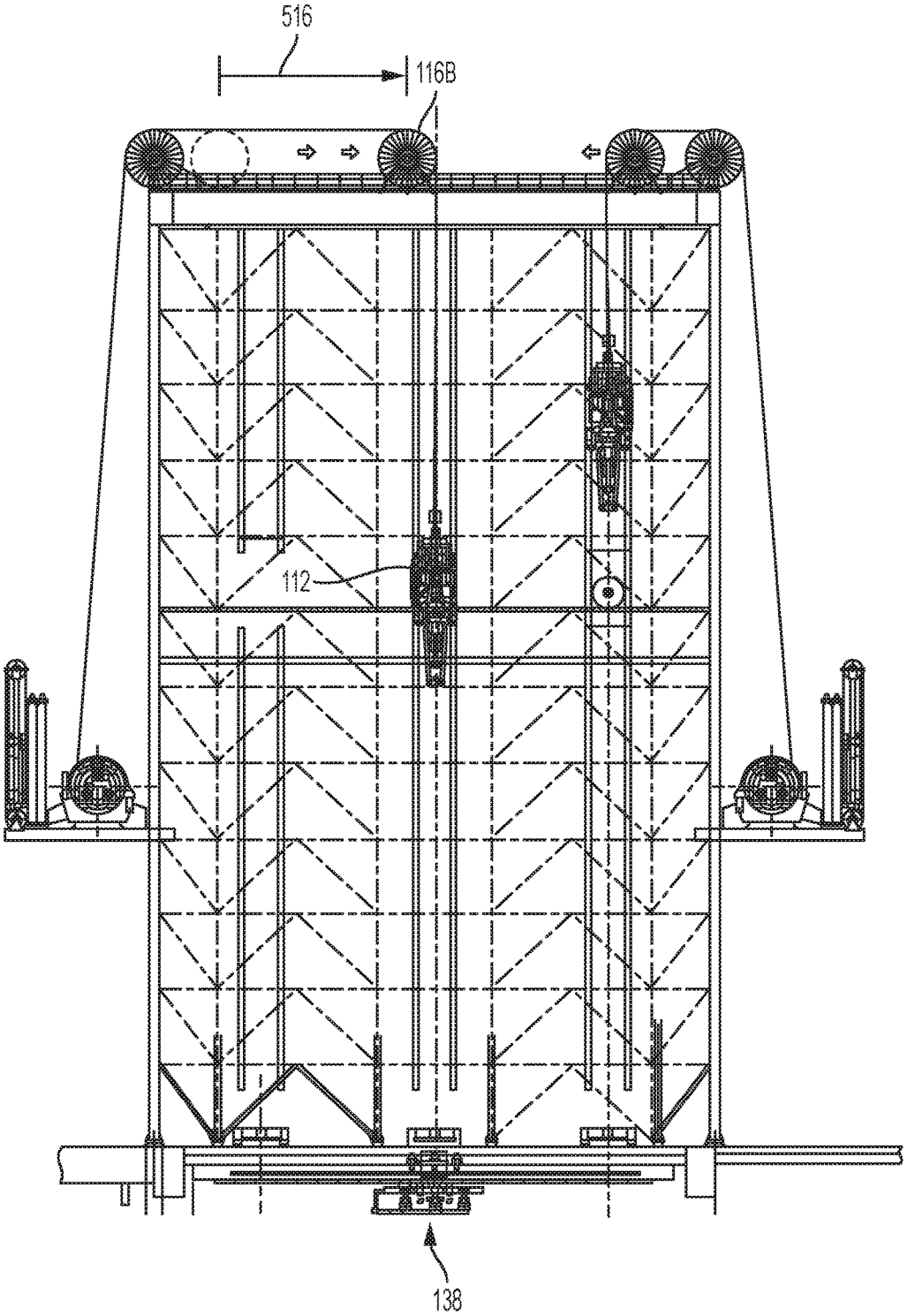
FIG. 5A is a side view of an example drilling derrick after moving a traveling block to a different well center according to one embodiment of the disclosure.
Figure 5B:
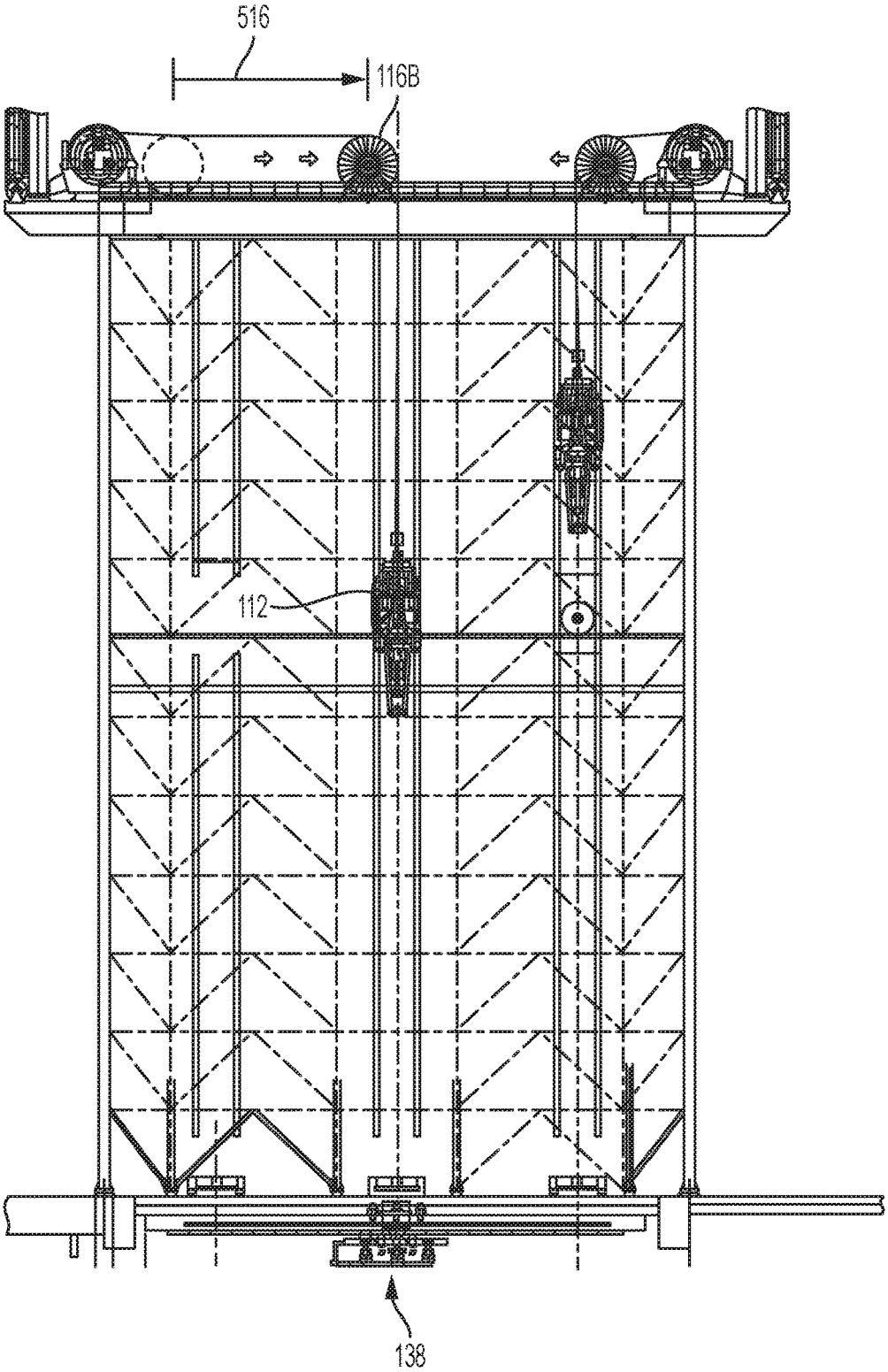
FIG. 5B is a side view of another example drilling derrick after moving a traveling block to a different well center according to one embodiment of the disclosure.
Figure 5C:
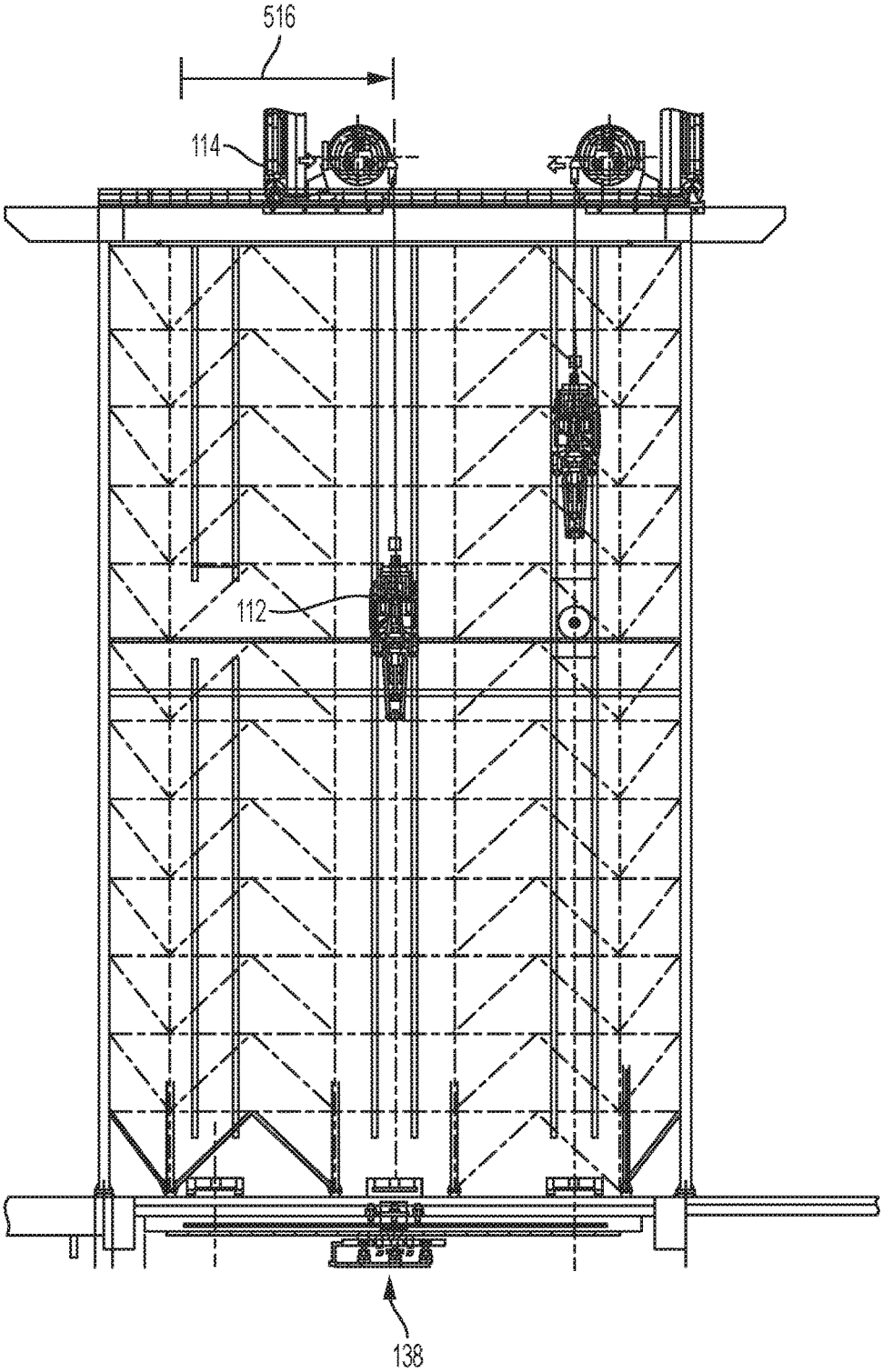
FIG. 5C is a side view of yet another example drilling derrick after moving a traveling block to a different well center according to one embodiment of the disclosure.

Then, at block 204, a sliding sheave set or a motor, depending on the configuration, may be moved from a first well center towards a second well center along with the traveling block, which skids towards the second well center. Examples of a derrick during skidding of the traveling block are shown in FIGS. 4A, 4B, and 4C. FIGS. 4A, 4B, and 4C are side views of example drilling derricks after moving a traveling block along a rack according to some embodiments of the disclosure. The traveling block 112 is skidded along the rack 312 along with the sliding sheave set 116B, in the configurations of FIGS. 4A and 4B, or the motor 114, in the configuration of FIG. 4C, by a distance 416. The movement may be continued until the traveling block 112 has moved from well center 118 to well center 138, as shown in FIGS. 5A, 5B, and 5C. FIGS. 5A, 5B, and 5C are side views of example drilling derricks after moving a traveling block to a different well center according to some embodiments of the disclosure. The traveling block 112 is positioned over the well center 138 in FIGS. 5A, 5B, and 5C after the sliding sheave set 116B, in the configurations of FIGS. 5A and 5B, or the motor 114, in the configuration of FIG. 5C, has completed movement by distance 516.

Steps of the method of FIG. 2 may be implemented by a controller 160 of, for example, FIGS. 1A-1C that is coupled to the motor 114, motor 124, drive system 152A (such as a motor (not shown) or a hydraulic ram type system) configured to move the motor 114, drive system 152B (such as a motor (not shown) or a hydraulic ram type system) configured to move the motor 124, a sliding sheave set moving mechanism (such as a motor (not shown) or a hydraulic ram type system) configured to move the sliding sheave set 116B, and/or a sliding sheave set moving mechanism (such as a motor (not shown) or a hydraulic ram type system) configured to move the sliding sheave set 126B. In the configurations of FIGS. 1A and 1B, the sliding sheave sets 116B and 126B operate from mechanisms and power systems different from that of the motors 114 and 124. In some embodiments, the motors 114 and/or 124 may operate to reel in or out the drill lines while the sheave sets 116B and/or 126B are moving in order to maintain a desired height of the traveling block. In the configuration of FIG. 1C, the motors 114 and 124 operate to reel in or out the drill lines from mechanisms and power systems different from that of the drive systems 152A and 152B that drives movement of the motors 114, 124, respectively, along skid beam 150. The controller 160 may include hardware circuitry or a general processing unit configured to perform steps that carry out portions or all of the method 200 shown in FIG. 2. In embodiments employing movable motors such as the embodiment shown in FIG. 1C, the motors need not operate to reel in or out the drill lines while moving in order to maintain the desired height of the traveling block. Thus, in such a configuration, controller 160 need not include hardware circuitry or a general processing unit configured to perform this operation. The controller 160 may also be coupled to sensors throughout the derrick 100 that provide feedback regarding operation of components.

Figure 6:
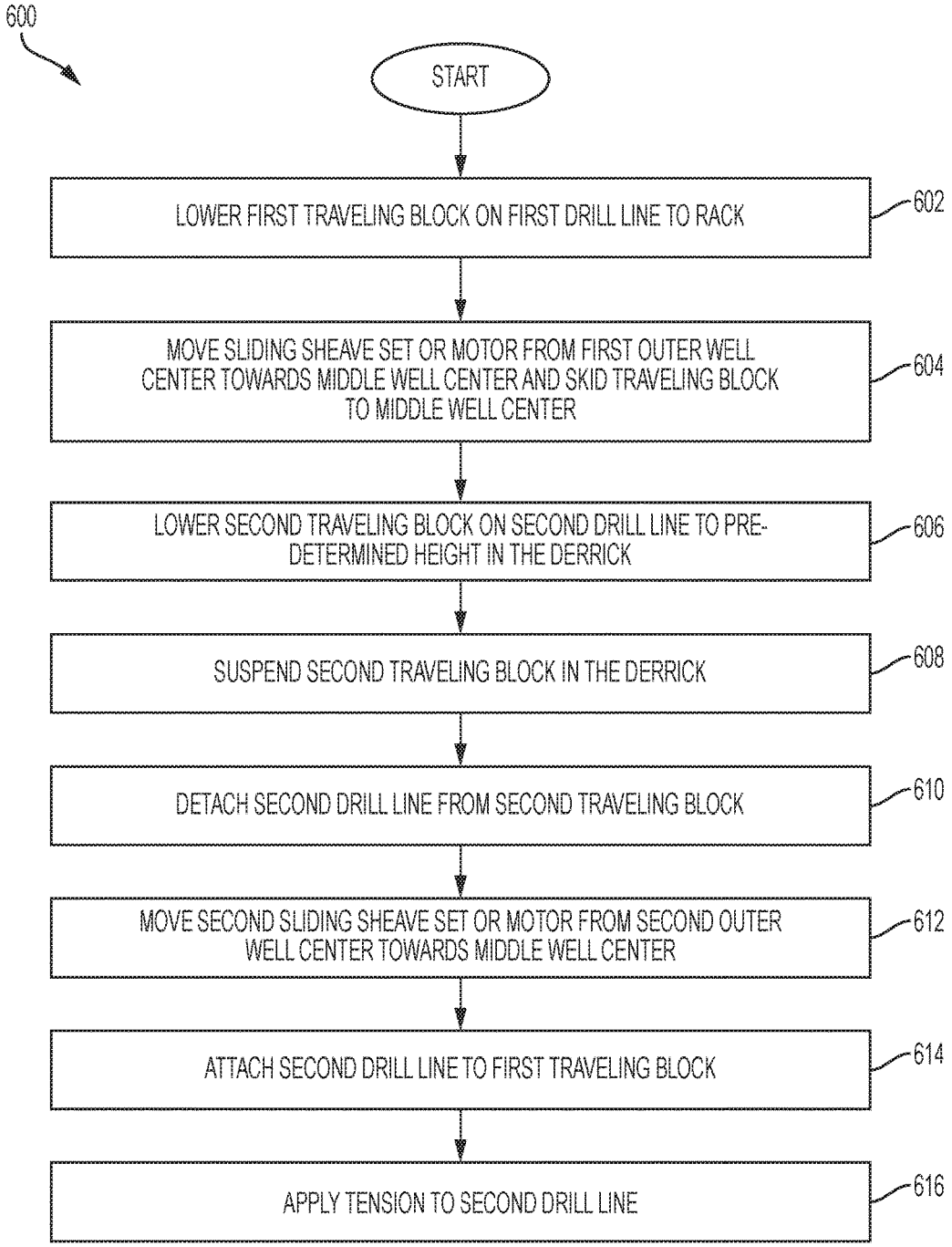
FIG. 6 is a flow chart illustrating an example method for operating a drill line over a well center with two motors according to some embodiments of the disclosure.
Figure 7A:
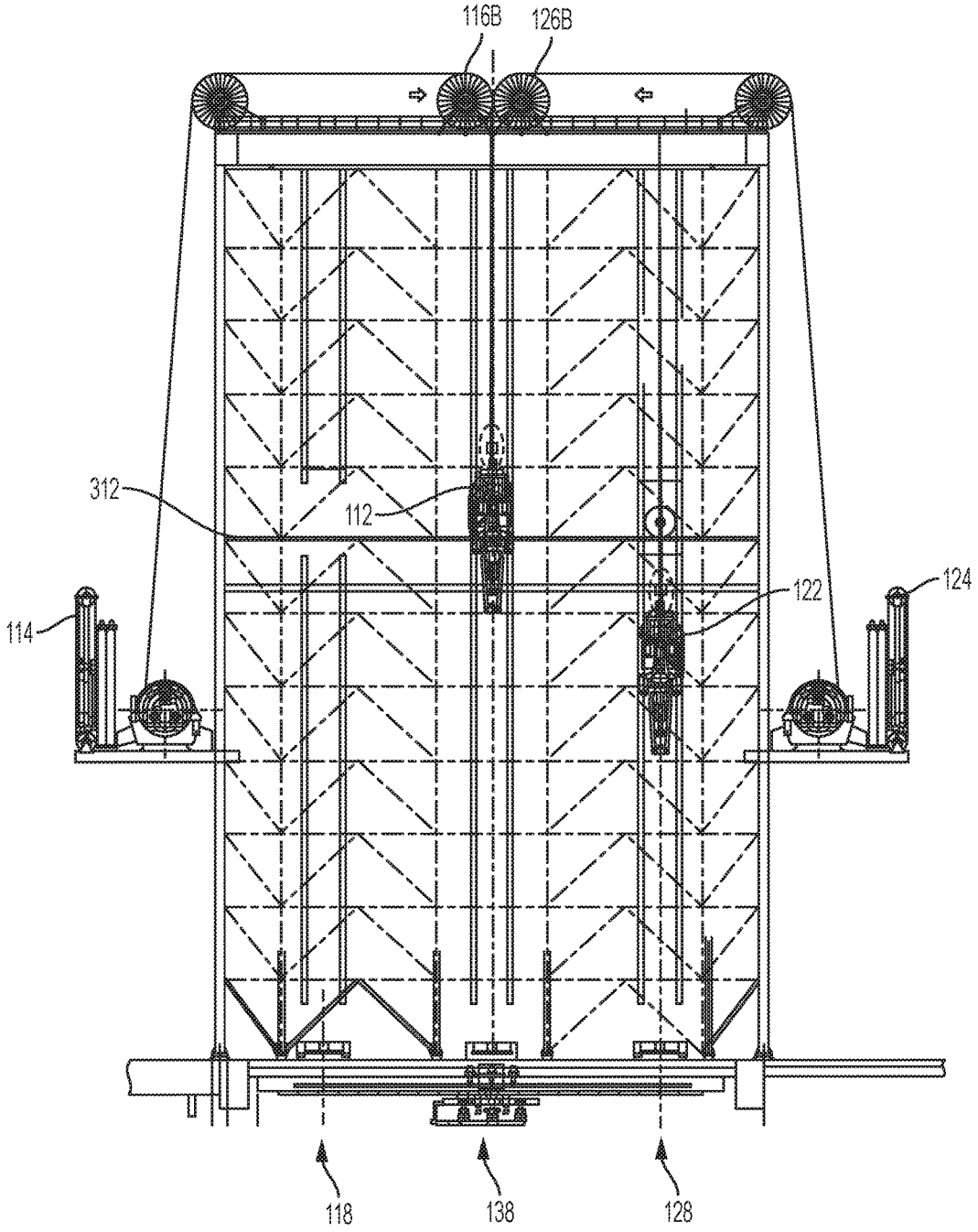
FIG. 7A is a side view of an example drilling derrick after coupling two motors to a traveling block and dangling another traveling block according to one embodiment of the disclosure.
Figure 7B:
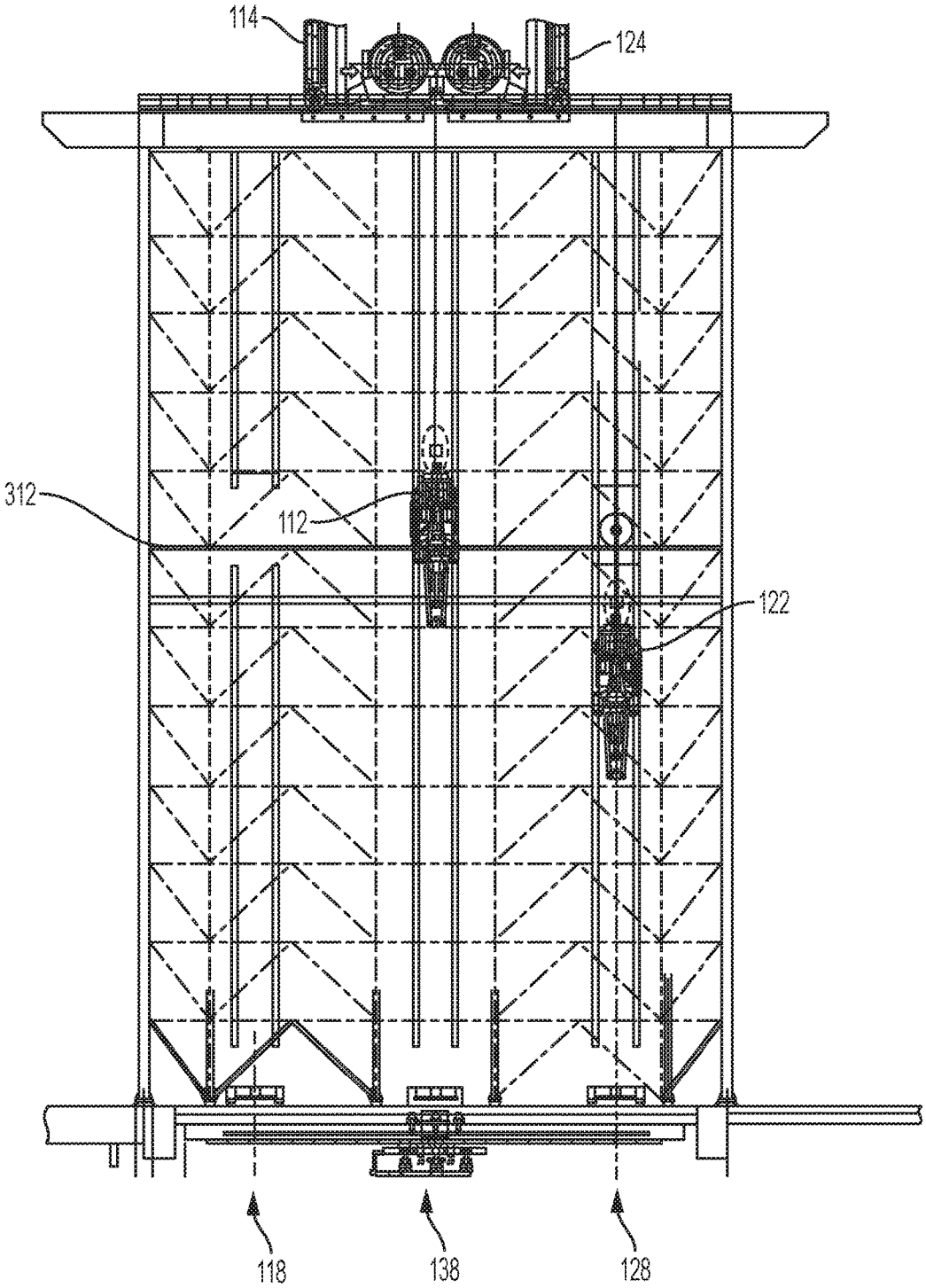
FIG. 7B is a side view of an another example drilling derrick after coupling two motors to a traveling block and dangling another traveling block according to one embodiment of the disclosure.

A configurable derrick, such as the embodiment of derrick 100 in any of FIGS. 1A-1C, may be used to increase pulling power on one of the drill lines by disconnecting the traveling block of one assembly and using the motor of that assembly to operate a drill line of another assembly. This may be achieved by dangling, i.e. suspending, one of the traveling blocks, such as shown in FIGS. 7A and 7B, at another location of the derrick and attaching the drill line of the suspended traveling block to an active traveling block. One example method for performing this operation is described with reference to FIG. 6. FIG. 6 is a flow chart illustrating an example method for operating a drill line over a well center with two motors according to some embodiments of the disclosure.

In a first portion of the method, a traveling block may be moved from an active well center to another well center. A method 600 may begin at block 602 with lowering a first traveling block on a first drill line to a rack of the derrick. Then, at block 604, a first sliding sheave set from a first assembly or a first motor, such as a single layer winch, at a first outer well center may be moved towards a middle well center and skid the traveling block to the middle well center. In some embodiments, a traveling block may already be located at a well center, such as the middle well center, needing two or more traveling blocks, and blocks 602 and 604 may be omitted. In other embodiments, different configurations of the derrick may exist and other steps performed to move a first traveling block to the middle well center or other well center.

Examples of a derrick, such as the derrick 100 of FIGS. 1A and 1C, in configuration with two motors operating a single traveling block are shown in FIGS. 7A and 7B, respectively. FIGS. 7A and 7B are side views of example drilling derricks after coupling two motors to a traveling block and dangling another traveling block according to some embodiments of the disclosure. In FIGS. 7A and 7B, the first traveling block 112 is shown skidded, along the rack 312, from the first outer well center 118 to the middle well 138. In FIG. 7A, the skidding along the rack 312 may be guided by, facilitated by, or otherwise made possible, at least in part, by the moving sheave 116B. In FIG. 7B, the skidding along rack 312 may be guided by, facilitated by, or otherwise made possible, at least in part, by moving motor 114.

Referring back to FIG. 6, in a second portion of the method 600, a second traveling block is suspended from the derrick to free a drill line and motor from operation. At block 606, a second traveling block may be lowered on a second drill line, such as to a pre-determined height in the derrick. Then, at block 608, the second traveling block may be suspended in the derrick. Next, at block 610, the second drill line is detached from the second traveling block.

In a third portion of the method 600, the second drill line and attached motor may be repurposed for operating the first drill line and be attached to the first traveling block. At block 612, a second sliding sheave set, corresponding to a second motor for the second drill line (see FIG. 7A), or a second motor, such as a single layer winch, for the second drill line (see FIG. 7B), may be moved or skidded from a second outer well center to the middle well center. Next, at block 614, the second drill line is attached to the first traveling block. Then, at block 616, tension is applied to the second drill line in combination with operation of the first motor attached to the first drill line. For example, the first motor and second motor may operate simultaneously to provide double the pulling capacity normally available on a drill line. As a further example, the first motor and the second motor may provide redundancy, such that if one motor fails during operation of the drill line, the other motor may continue to provide tension to prevent loss of equipment or life during operation. As yet a further example, the first motor and second motor may operate at half the power normally needed to operate the drill line so as to prolong the life of the first and second motor by decreasing the stress experienced by the first and second motors. Although a certain well configuration of outer and middle wells is described as part of the method 600, the method 600 may be applied to any two or more wells. The method 600 may be extended to moving three or more traveling blocks to a single well to provide additional capacity or redundancy.

Figure 7C:
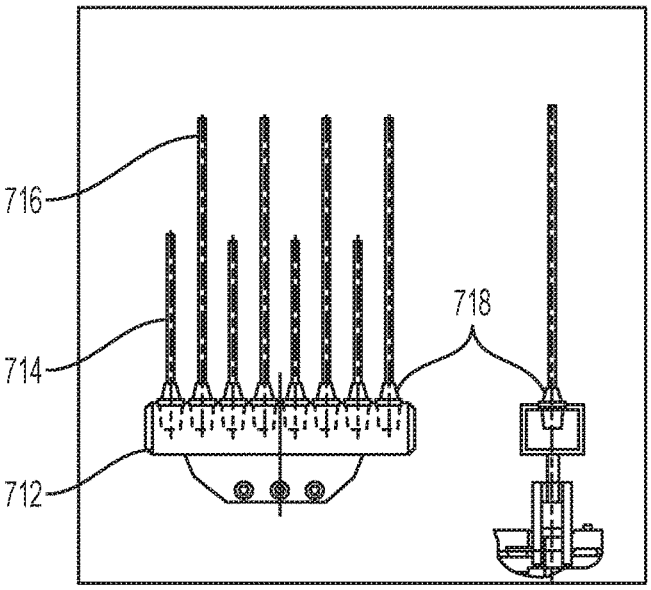
FIG. 7C is a schematic illustrating an example traveling block configuration for operating from two sheaves or motors according to one embodiment of the disclosure.

The components of the derrick may be configured to support operation in one or more operational modes, including normal operation mode and combined operation mode, in which two or more motors may pull the same traveling block to increase available power and capacity for moving the second traveling block or reduce the amount power and capacity required for each motor to move the second traveling block. The method illustrated in FIG. 6 is one method for switching the configurations of the derrick. One traveling block configuration supporting reconfiguration is shown in FIG. 7C. FIG. 7C is a schematic illustrating an example traveling block configuration (only a portion of the traveling block shown) for operating from two sheaves or motors according to embodiments of the disclosure. A traveling block 712 (only a portion of which is shown in FIG. 7C) may be configured to connect to multiple sheaves and/or multiple motors. For example, the traveling block 712 may couple through first drill lines 714 to a first motor (not shown) and couple through second drill lines 716 to a second motor (not shown). In some embodiments, the drill lines may be attached to the traveling block 712 by quick connect connectors, such as quick connect connectors 718. In some embodiments, the drill lines may be attached and detached through remote operation. Although FIG. 7C shows multiple drill lines coupled to multiple connectors, a single connector may service a plurality or all of the drill lines to the traveling block 712.

Figure 7D:
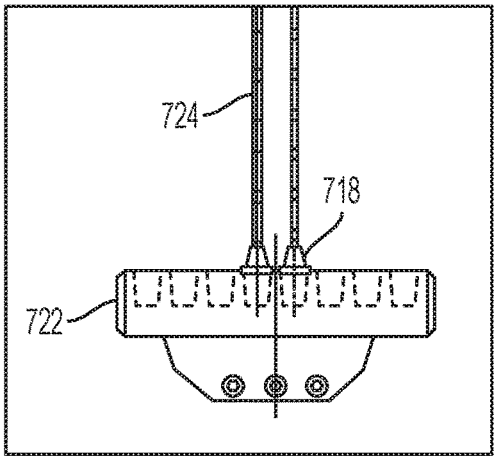
FIG. 7D is a schematic illustrating an example traveling block configuration for dangling the traveling block according to one embodiment of the disclosure.

When multiple drill lines are attached to the first traveling block, the second traveling block (and other traveling blocks, if present) may be suspended from the derrick while its associated drill line(s) is/are used for other traveling blocks. One example configuration for hanging, i.e. suspending, dangling, a traveling block during an inactive period is shown in FIG. 7D. FIG. 7D is a schematic illustrating an example traveling block configuration (only a portion of the traveling block shown) for suspending a traveling block 722 according to one embodiment of the disclosure. Illustrated in FIG. 7D are two hang-off lines 724 attached to a traveling block. These two lines may be fixed to the derrick and may suspend the traveling block/RHC assembly 722 in the derrick. When suspended, the drill lines of traveling block 722 (not shown) may be detached from traveling block 722 and attached to the other traveling blocks. In some embodiments, a derrick may include two or more sets of hang-off lines in the derrick: one aft set for suspending the first traveling block and one forward set for suspending the second traveling block. In such an embodiment, both traveling blocks may be suspended and both traveling blocks may have both sets of drill lines attached.

Figure 8:
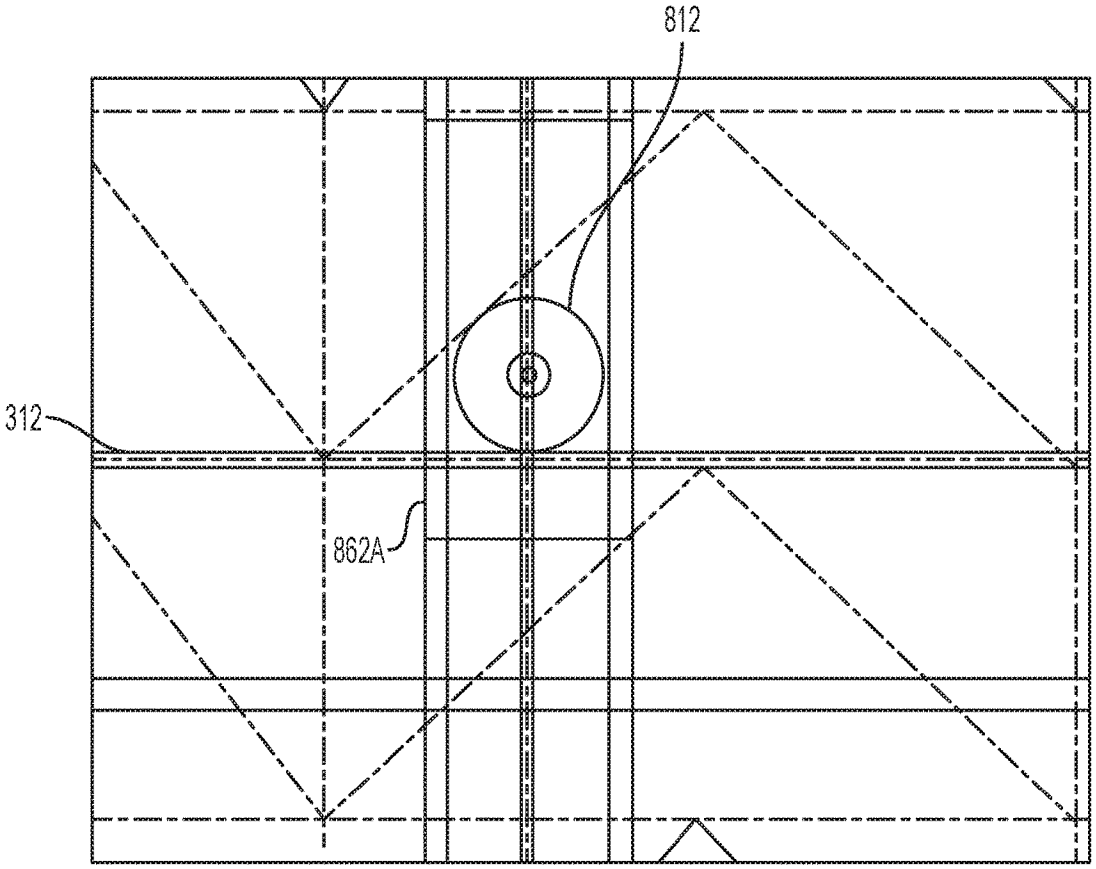
FIG. 8 is a side view of an example rail skidding mechanism according to one embodiment of the disclosure.

As shown in FIG. 1A, FIG. 1B, FIG. 1C, and other figures and described herein, a rack 312 may assist in the transfer of a traveling block from one well center to another well center. In some embodiments, a rail skidding mechanism may be attached to the rack 312 and provided to assist in such a transfer. FIG. 8 is a side view of an example rail skidding mechanism according to one embodiment of the disclosure. FIG. 8 shows a rack-and-pinion-type system (some elements not shown), whereby a wheel 812, which is attached to a moveable section of guiderail 862A (i.e., a separation joint), rotates across the rack 312 moving the guiderail section 862A between well centers. However, FIG. 8 is only one embodiment of a rail skidding mechanism and other mechanisms may be used for skidding a traveling block across well centers, such as through other mechanized drive devices.

Figure 9A:
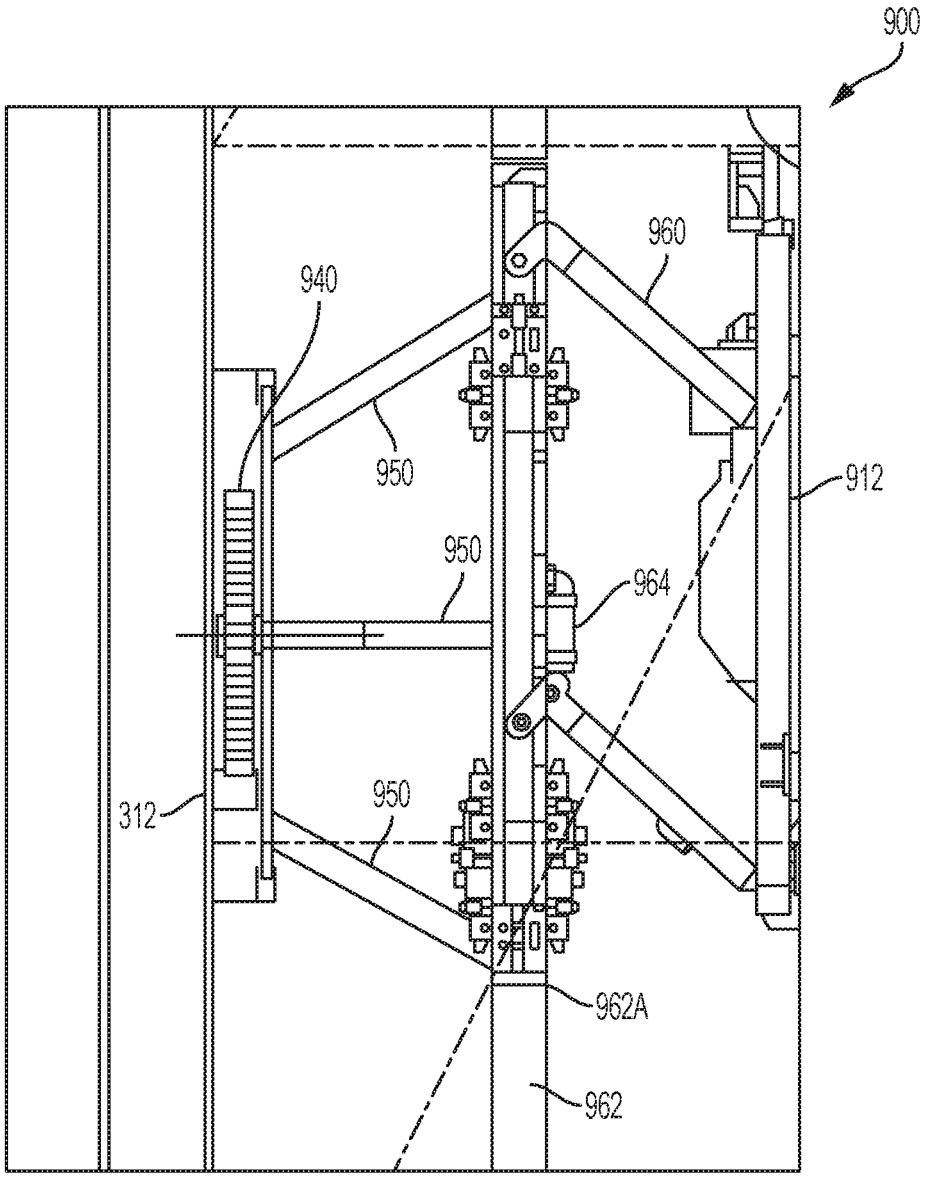
FIG. 9A is a front view of an example rail skidding system according to one embodiment of the disclosure.

FIG. 9A is an aft view of an example rail skidding system 900 according to one embodiment of the disclosure. A traveling block 912 (only a portion of which is shown in FIG. 9A) is coupled to guide rails (i.e., dolly tracks) 962 via retractable dolly 960, which can retract traveling block 912 via operation of an actuator 964 (hydraulic, pneumatic, electric, or the like). Guide rails 962 include a separation joint 962A that allows rail skidding mechanism 940, which is coupled to separation joint 962A, via, e.g., supports 950, to move traveling block 912 along a rail (such as rail 312 of FIG. 8) when retractable dolly 960 is received in separation joint 962A. Rail skidding mechanism 940 can be a passive element operated indirectly by movement of a sliding sheave or motor at the top of the derrick, or it can be an active element having its own drive system, such as a motor. If rail skidding mechanism 940 is an active element, a control system, such as controller 160 of FIGS. 1A-1C, can be coupled to it and configured to coordinate movement of rail skidding mechanism 940 with movement of the sliding sheave or motor at the top of the derrick.

The rail skidding mechanism shown in FIG. 9A may be used to move a guiderail separation joint and top drives between well centers as described in the description above. Each well center may have a set of traveling block guide rails (or dolly tracks) for each well center. The guiderails may include a section of the guiderail that can move between well centers (i.e., a separation joint) while providing lateral support to the traveling block. That is, the traveling block may remain attached or otherwise supported by that section of the guiderail that is moving between well centers. A rail skidding mechanism may be fixed to the moveable sections of guiderails and may skid or move the guiderail section (either when empty or while supporting a traveling block) between two or more well centers. In one embodiment, this mechanism is the rack-and-pinion-type arrangement shown in FIGS. 8 and 9A. The moveable guiderail sections may align and seamlessly interface with the fixed guiderail sections on each well center to allow the traveling block to be raised and lowered on each well center, while being supported laterally by the complete guiderail arrangement. The moveable guiderails may move synchronously with the relevant skidding crown sheave set when providing lateral support to a traveling block. During this movement between well centers, the motor or winch may reel the drill lines in (or out), if necessary, to maintain the traveling block at a constant height, and thereby stationary with respect to the moveable guiderails.

Figure 9B:
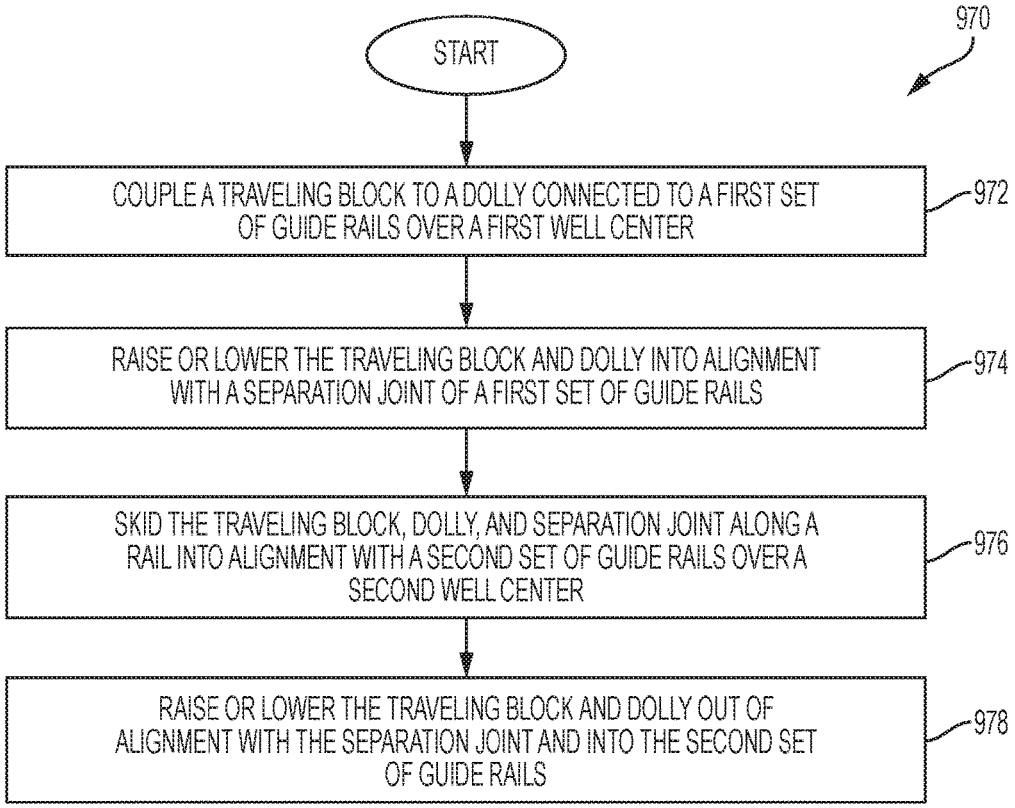
FIG. 9B is a flow chart illustrating an example method of moving a RHC traveling block/top drive between well centers using a rail skidding system according to one embodiment of the disclosure.

FIG. 9B is a flow chart of an example method 970 of moving a RHC traveling block/top drive between well centers using a rail skidding system, such as rail skidding system 900, according to one embodiment of the disclosure. In a first step 972 of the method 970, a traveling block or other type of RHC system is coupled to a first set of drill lines over a first well center and also coupled to a dolly, where a portion of the dolly is disposed in a first set of guide rails of a derrick. The dolly can be a retractable-type dolly like that shown in FIG. 9A or FIG. 11 below, and the first set of drill lines can be coupled to a first motor such as motor 114 of FIGS. 1A-1C. In a second step 974, the traveling block is raised or lowered into alignment with a separation joint, for example, separation join 962A, of the first set of guide rails. In a third step 976, the traveling block, dolly, and separation joint are skidded along a rail, such as rail 312 of FIG. 8, via a skidding mechanism, such as skidding mechanism 940, into alignment with a second set of guide rails disposed over a second well center. In a fourth step 978, the traveling block and dolly are raised or lowered out of the separation joint into the second set of guide rails for performance of operations over the second well center. For example, the traveling block may be coupled to a second set of drill lines coupled to a second motor, such as motor 124 of FIGS. 1A-1C, for a combined lifting operation, as explained with reference to FIGS. 7A-7D.

Figure 10A:
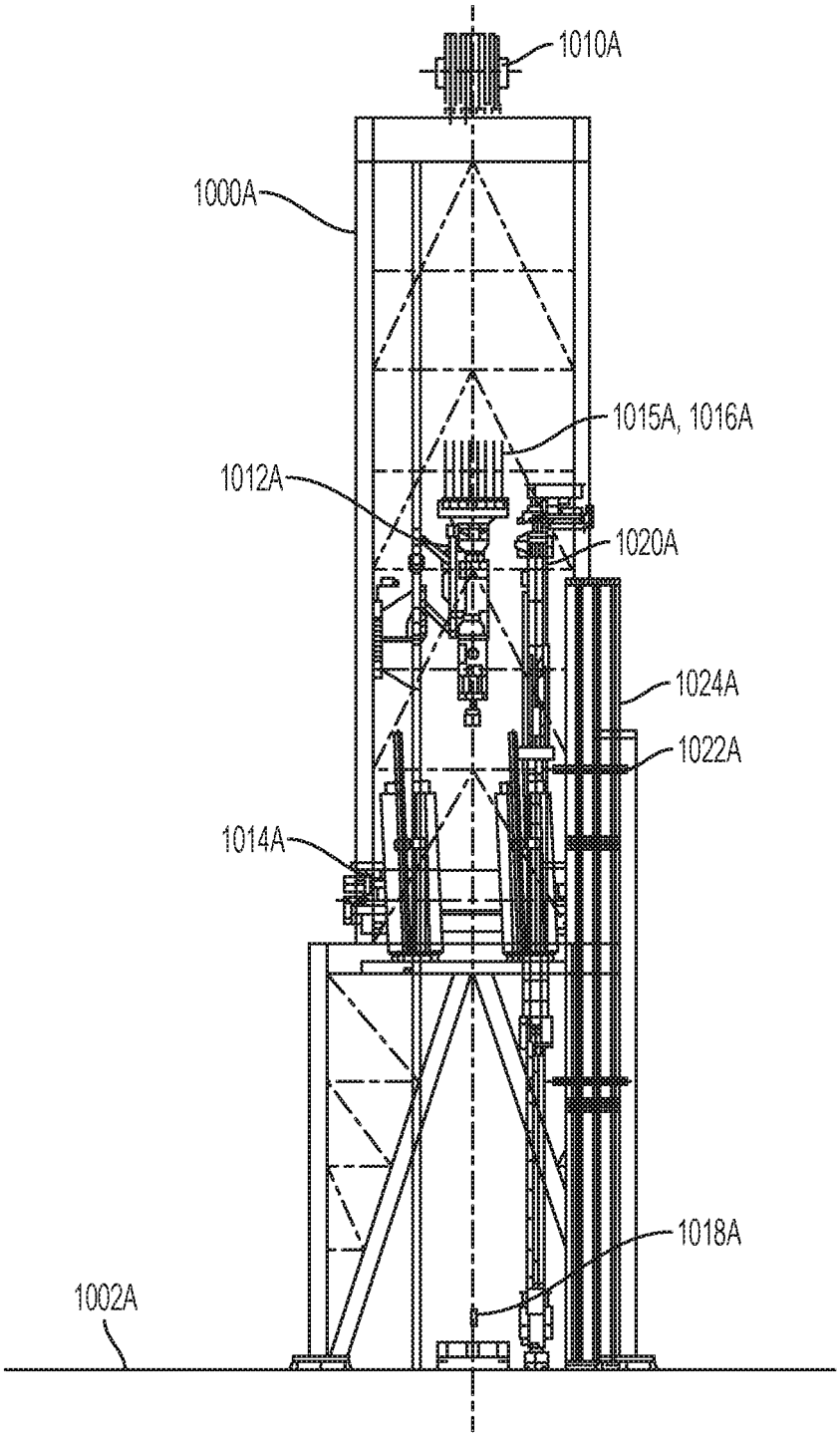
FIG. 10A is an aft view of an example arrangement of a single layer winch, sheaves, and traveling block arranged in parallel to well centers according to one embodiment of the disclosure.
Figure 10B:
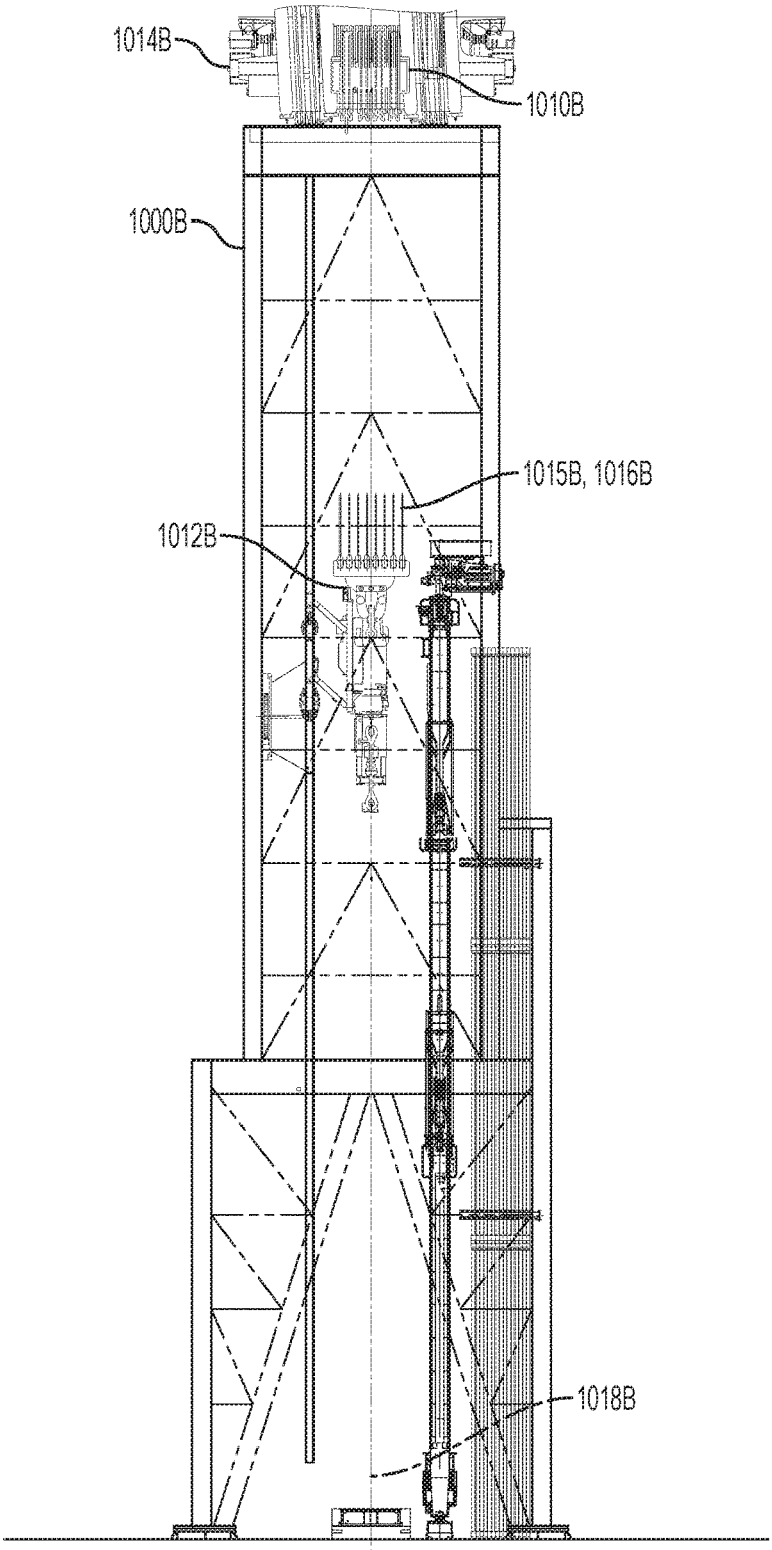
FIG. 10B is an aft view of another example arrangement of a single layer winch, sheaves, and traveling block arranged in parallel to well centers according to one embodiment of the disclosure.
Figure 10C:
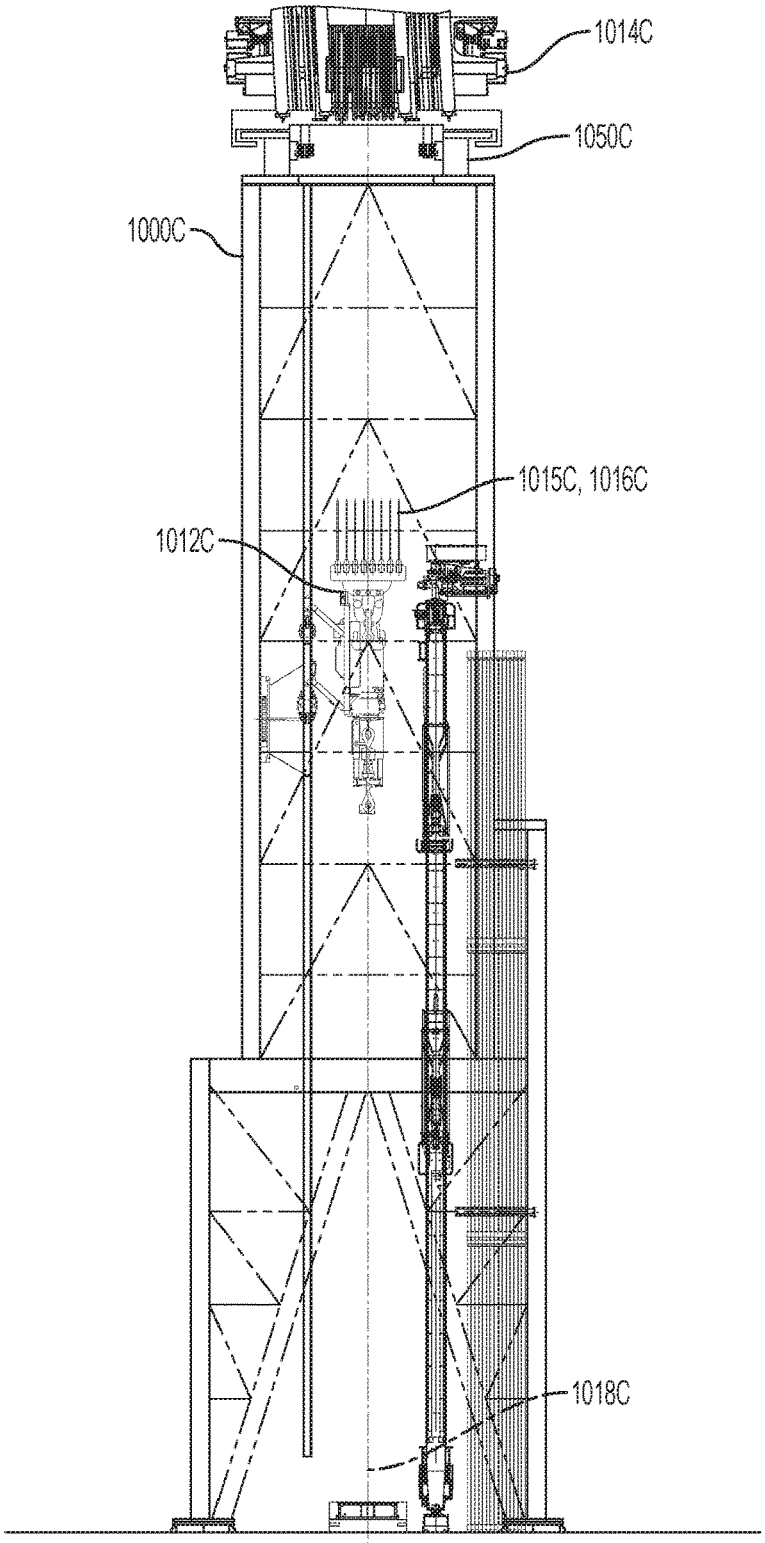
FIG. 10C is an aft view of an arrangement of a single layer winch and traveling block arranged in parallel to well centers according to one embodiment of the disclosure.

FIG. 10A is an aft view of an example arrangement of a single layer winch 1014A, sheaves 1010A, and traveling block 1012A arranged in parallel to well centers 1018A partially showing two sets of drill lines 1015A, 1016A to be attached to the single traveling block 1012A according to one embodiment of the disclosure. In operation, the traveling block 1012A may be raised to a height, i.e., a make-up/break-out height, at operating height of a tubular transfer mechanism 1020A, such as a PRS. The tubular handling mechanism 1020A may transfer tubulars between traveling block 1012A and finger boards 1022A of a setback area 1024A of the derrick 1000A. The tubulars may also be stored and retrieved from other locations or via other arrangements, such as below the rigfloor 1002A. FIG. 10B is an aft view of another example arrangement of a single layer winch 1014B, sheaves 1010B, and traveling block 1012B arranged in parallel to well centers 1018B showing two sets of drill lines 1015B, 1016B to be attached to the single traveling block 1012B according to one embodiment of the disclosure. The example shown in FIG. 10B shows a parallel traveling block arrangement with a derrick 1000B having motors mounted on top of the derrick structure, as in FIG. 1B. FIG. 10C is an aft view of an example arrangement of a single layer winch 1014C and traveling block 1012C arranged in parallel to well centers 1018C showing two sets of drill lines 1015C, 1016C to be attached to the single traveling block 1012C according to one embodiment of the disclosure. The example shown in FIG. 10C shows a parallel traveling block arrangement with a derrick 1000C having motors mounted on top of the derrick along a skid beam 1050C and no sheaves, as in FIG. 1C. The parallel traveling block arrangements shown in FIGS. 10B and 10C can operate in the same manner as the arrangement shown in FIG. 10A, as described above.

Figure 11:
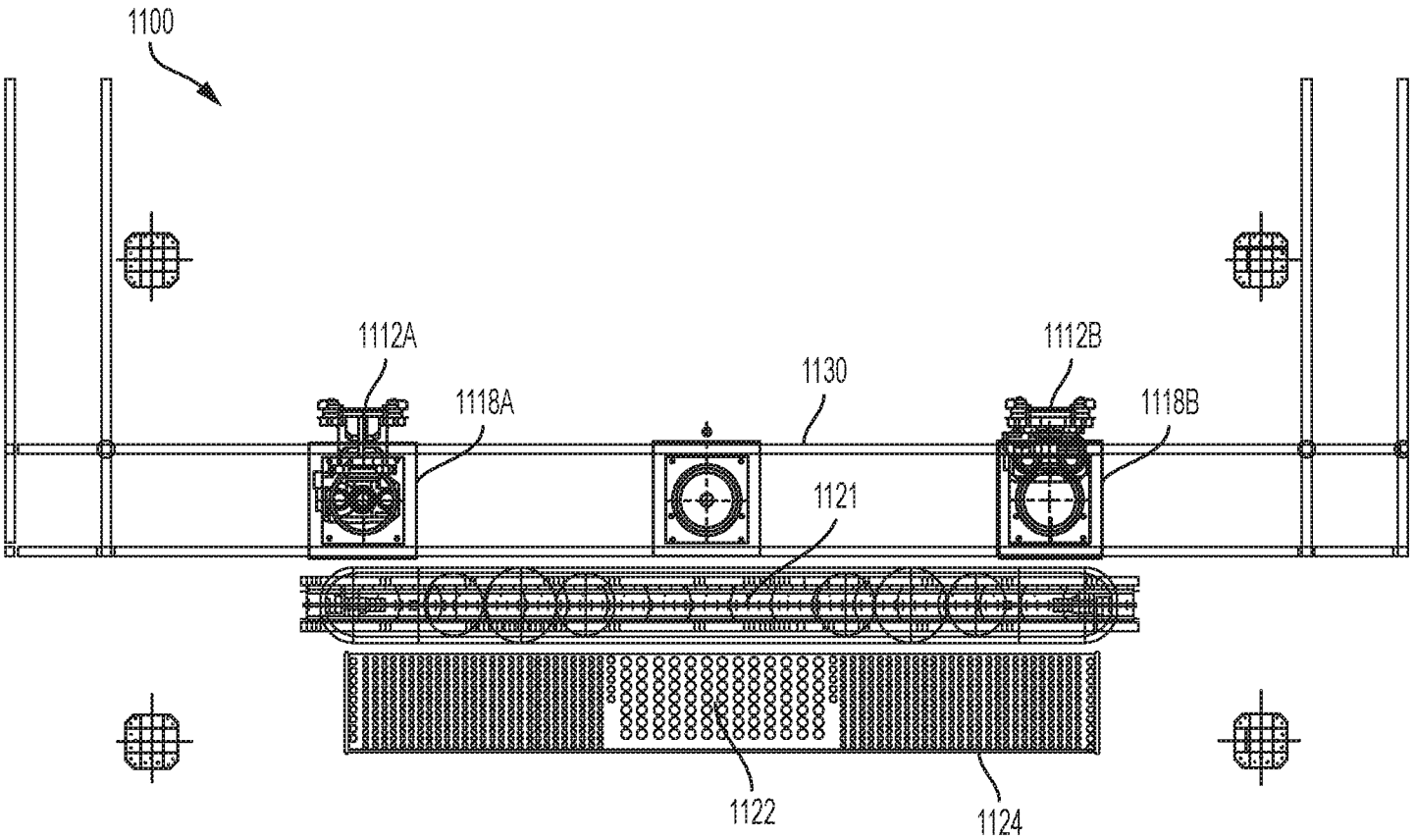
FIG. 11 is a plan view of an example configuration of false rotary table type skid carts (SFRTs) and skid rail arrangement on which the skid carts move according to one embodiment of the disclosure. Certain elements are not shown for clarity.

FIG. 11 is a plan view of an example configuration 1100 of false rotary table type skid carts (SFRTs) and skid rail arrangement on which the skid carts move according to one embodiment of the disclosure. Certain elements, such as motors and/or sheaves, are not shown for clarity. A first traveling block 1112A is shown in an extended position over SFRT 1118A and a second traveling block 1112B is shown in a retracted position over SFRT 1118B. First and second traveling blocks 1112A, 1112B can be extended or retracted via a retractable dolly such as dolly 960 of FIG. 9A. When in the retracted position, a traveling block, such as traveling block 1112B, causes less torque on the dolly and guide rails. Traveling blocks 1112A, 1112B and/or SFRTs 1118A, 1118B can provide or receive a tubular, tubular stand, or other equipment from a tubular transfer mechanism (not shown), such as a PRS, in either the extended or retracted positions, depending on the configuration of the tubular transfer mechanism and traveling blocks. The tubular transfer mechanism can travel along path 1121 and can rotate between a setback area 1124 and the skid path of the traveling blocks and/or SFRTs. Setback area 1124 can include different types of tubulars and other equipment 1122 that can be used in operations of the traveling blocks. The tubulars and/or other equipment may also be stored and retrieved from other locations or via other arrangements, such as below the rigfloor. SFRTs 1118A and 1118B can travel along bottom skid rails 1130, which extend the entire length between the multiple well centers. Bottom skid rails 1130 may also extend beyond an outer well center where additional operations/services may be performed and/or maintenance may be received. In such a configuration, the top skid beam and middle skid rail of the derrick may also extend beyond the outer well center such that traveling blocks and sheaves and/or motors may perform such additional operations/service and/or receive maintenance as well.

The schematic flow chart diagrams of FIGS. 2, 6, and 9B are generally set forth as a logical flow chart diagram. As such, the depicted order and labeled steps are indicative of aspects of the disclosed method. Other steps and methods may be conceived that are equivalent in function, logic, or effect to one or more steps, or portions thereof, of the illustrated method. Additionally, the format and symbols employed are provided to explain the logical steps of the method and are understood not to limit the scope of the method. Although various arrow types and line types may be employed in the flow chart diagram, they are understood not to limit the scope of the corresponding method. Indeed, some arrows or other connectors may be used to indicate only the logical flow of the method. For instance, an arrow may indicate a waiting or monitoring period of unspecified duration between enumerated steps of the depicted method. Additionally, the order in which a particular method occurs may or may not strictly adhere to the order of the corresponding steps shown.

The operations described above, such as in the schematic flow chart diagrams, may be executed by the controller 160. Such a circuit may be an integrated circuit (IC) constructed on a semiconductor substrate and include logic circuitry, such as transistors configured as logic gates, and memory circuitry, such as transistors and capacitors configured as dynamic random access memory (DRAM), electronically programmable read-only memory (EPROM), or other memory devices. The logic circuitry may be configured through hard-wire connections or through programming by instructions contained in firmware. Further, the logic circuitry may be configured as a general purpose processor capable of executing instructions contained in software. If implemented in firmware and/or software, functions described above may be stored as one or more instructions or code on a computer-readable medium. Examples include non-transitory computer-readable media encoded with a data structure and computer-readable media encoded with a computer program. Computer-readable media includes physical computer storage media. A storage medium may be any available medium that can be accessed by a computer. By way of example, and not limitation, such computer-readable media can comprise random access memory (RAM), read-only memory (ROM), electrically-erasable programmable read-only memory (EEPROM), compact disc read-only memory (CD-ROM) or other optical disk storage, magnetic disk storage or other magnetic storage devices, or any other medium that can be used to store desired program code in the form of instructions or data structures and that can be accessed by a computer. Disk and disc includes compact discs (CD), laser discs, optical discs, digital versatile discs (DVD), floppy disks and Blu-ray discs. Generally, disks reproduce data magnetically, and discs reproduce data optically. Combinations of the above should also be included within the scope of computer-readable media.

In addition to storage on computer readable medium, instructions and/or data may be provided as signals on transmission media included in a communication apparatus. For example, a communication apparatus may include a transceiver having signals indicative of instructions and data. The instructions and data are configured to cause one or more processors to implement the functions outlined in the claims.

Although the present disclosure and certain representative advantages have been described in detail, it should be understood that various changes, substitutions and alterations can be made herein without departing from the spirit and scope of the disclosure as defined by the appended claims. Moreover, the scope of the present application is not intended to be limited to the particular embodiments of the process, machine, manufacture, composition of matter, means, methods and steps described in the specification. For example, although a particular traveling block may be referred to as being suspended, either of or both of the traveling blocks may be capable of being suspended. As one of ordinary skill in the art will readily appreciate from the present disclosure, processes, machines, manufacture, compositions of matter, means, methods, or steps, presently existing or later to be developed that perform substantially the same function or achieve substantially the same result as the corresponding embodiments described herein may be utilized. Accordingly, the appended claims are intended to include within their scope such processes, machines, manufacture, compositions of matter, means, methods, or steps.

What is claimed is:

1. An apparatus, comprising:

a derrick having a top;

a first motor configured to reel in and out a first drill line;

a second motor configured to reel in and out a second drill line;

a first traveling block configured to couple to the first drill line;

a second traveling block configured to couple to the second drill line;

a rack spanning at least two well centers, the rack fixed to the derrick below the top;

a rail skidding mechanism coupled to the rack and configured to allow skidding of the first traveling block between some of the at least two well centers; and a controller coupled to the first motor and the second motor and configured to perform steps including:

controlling the first motor to adjust a height of the first traveling block to the rack;

controlling the first motor to skid the first traveling block from a first well center of the at least two well centers to a second well center of the at least two well centers;

controlling the second motor to adjust a height of the second traveling block to the rack;

controlling the second motor to skid the second drill line from a third well center of the at least two well centers to the second well center of the at least two well centers; and controlling the first motor and the second motor to reel in or reel out the first drill line and the second drill line to adjust a height of the first traveling block.

2. The apparatus of claim 1, wherein the rack spans three well centers comprising a first outer well center, a second outer well center, and a middle well center, and wherein the rail skidding mechanism is configured to allow the first traveling block to skid from the first outer well center to the middle well center.

3. The apparatus of claim 1, wherein the first motor and the second motor are mounted at a height above a rigfloor.

4. The apparatus of claim 1, wherein the first traveling block is configured to couple to at least two drill lines including the first drill line and the second drill line.

5. The apparatus of claim 4, wherein the first traveling block is configured to couple to the second drill line by a quick connector.

6. The apparatus of claim 1, wherein the first or second traveling block is configured to hang-off from the rack.

7. The apparatus of claim 1, wherein the apparatus is a drilling derrick comprising a plurality of false rotary tables arranged around the at least two well centers.

8. The apparatus of claim 1, wherein the first traveling block comprises a drilling rotating/hoisting/circulation (RHC) traveling block.

9. An apparatus, comprising:

a derrick having a top;

a first motor configured to reel in and out a first drill line;

a second motor configured to reel in and out a second drill line;

a first traveling block configured to couple to the first drill line;

a second traveling block configured to couple to the second drill line;

a rack spanning at least two well centers, the rack fixed to the derrick below the top;

a rail skidding mechanism coupled to the rack and configured to allow skidding of the first traveling block between some of the at least two well centers;

a first sheave set comprising at least a first movable sheave and configured to reel in and reel out the first drill line;

a second sheave set comprising at least a second movable sheave and configured to reel in and out the second drill line; and a controller coupled to the first motor and the second motor and the first moveable sheave and the second movable sheave and configured to perform steps including:

control the first motor to adjust a height of the first traveling block to the rack; and control the first moveable sheave to skid the first traveling block from a first well center of the at least two well centers to a second well center of the at least two well centers.

10. The apparatus of claim 9, wherein the first movable sheave is configured to move to skid the first traveling block between the first well center and the second well center.

11. The apparatus of claim 9, wherein the first motor and the second motor are mounted at the top of the derrick structure to which are attached the first sheave set, the second sheave set, the first traveling block, the second traveling block, the rack, and the rail skidding mechanism.

12. The apparatus of claim 9, wherein the controller is further configured to perform steps including:

controlling the first motor to adjust a height of the first traveling block to the rack;

controlling the first motor to skid the first traveling block from a first well center of the at least two well centers to a second well center of the at least two well centers;

controlling the second motor to adjust a height of the second traveling block to the rack;

controlling the second motor to skid the second drill line from a third well center of the at least two well centers to the second well center of the at least two well centers; and controlling the first motor and the second motor to reel in or reel out the first drill line and the second drill line to adjust a height of the first traveling block.

13. The apparatus of claim 12, wherein the first traveling block is configured to couple to at least two drill lines including the first drill line and the second drill line.

14. The apparatus of claim 13, wherein the first traveling block is configured to couple to the second drill line by a quick connect connector.

15. The apparatus of claim 12, wherein the first or second traveling block is configured to hang-off from the rack.

16. A method, comprising:

controlling a first motor to adjust a height of a first traveling block to a rack fixed on a derrick below a top of the derrick;

controlling a first pulley system coupled to the first traveling block to skid, along the rack, the first traveling block from a first well center to a second well center controlling a second motor to adjust a height of a second traveling block to the rack;

controlling a second pulley system to skid a second drill line from a third well center to the second well center; and controlling the first motor and the second motor to reel in or reel out the first drill line and the second drill line to adjust a height of the first traveling block.

17. The method of claim 16, wherein the first pulley system comprises at least one of a group comprising a first movable sheave and the first motor.

18. The method of claim 16, wherein:

the first pulley system comprises at least one of a group comprising a first movable sheave and the first motor, and the second pulley system comprises at least one of a group comprising a second movable sheave and the second motor.

19. The method of claim 16, further comprising:

suspending the second traveling block after adjusting the height of the second traveling block to the rack;

detaching the second drill line from the second traveling block after suspending the second traveling block; and attaching the second drill line to the first traveling block.

20. The method of claim 16, wherein the step of controlling the first motor and the second motor to reel in or reel out the first drill line and the second drill line to adjust a height of the first traveling block comprises pulling in the second drill line with power proportional to a sum of torque from the first motor and the second motor.

21. An apparatus, comprising:

a controller configured to couple to equipment on a derrick, the equipment comprising a first motor for reeling in or reeling out a first drill line, a second motor for reeling in or reeling out a second drill line, a first drive system for moving the first motor, and a second drive system for moving the second motor, wherein the controller is configured to perform steps comprising:

controlling the first motor to adjust a height of a first traveling block to a rack on the derrick by reeling in or reeling out the first drill line;

controlling the first drive system to move the first motor coupled to the first traveling block to skid, along the rack, the first traveling block from a first well center to a second well center;

controlling the second motor to adjust a height of a second traveling block to the rack;

controlling the second drive system to move the second motor to skid the second drill line from a third well center to the second well center; and controlling the first motor and the second motor to reel in or reel out the first drill line and the second drill line to adjust a height of the first traveling block.

* * * * *